US008085412B2

(12) United States Patent
Nishitani et al.

(10) Patent No.: US 8,085,412 B2
(45) Date of Patent: Dec. 27, 2011

(54) SHEET CONVEYING APPARATUS, SHEET CONVEYING METHOD, AND IMAGE FORMING APPARATUS

(75) Inventors: Hitoshi Nishitani, Tokyo (JP); Hideki Kawashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1177 days.

(21) Appl. No.: 11/834,585

(22) Filed: Aug. 6, 2007

(65) Prior Publication Data

US 2008/0030811 A1 Feb. 7, 2008

(30) Foreign Application Priority Data

Aug. 7, 2006 (JP) ..... 2006-214530

(51) Int. Cl.
*G06F 15/00* (2006.01)
*B65H 9/16* (2006.01)

(52) U.S. Cl. ..... 358/1.12; 271/251

(58) Field of Classification Search ..... 358/1.12, 358/1.2, 498, 474; 271/251, 228, 10.12, 271/242, 227; 399/395, 372, 370, 367; 347/16, 104, 19

See application file for complete search history.

(56) References Cited

U.S. PATENT DOCUMENTS 7,684,749 B2 * 3/2010 Yamane et al. ..... 399/395

FOREIGN PATENT DOCUMENTS

| | | |
|---|---|---|
| JP | 7-334630 | 12/1995 |
| JP | 8-208075 | 8/1996 |
| JP | 2005-306605 | 11/2005 |

* cited by examiner

*Primary Examiner* — Saeid Ebrahimi Dehkordy
(74) *Attorney, Agent, or Firm* — Canon USA Inc IP Division

(57) ABSTRACT

A sheet conveying apparatus includes a skew amount detecting unit configured to detect an amount of skew of a sheet, two rollers configured to convey the sheet in a predetermined conveyance direction when rotating in a same direction and to rotate the sheet around a predetermined point when rotating in mutually different directions, and a control unit configured to control the two rollers such that the two rollers convey the sheet to a position where a distance from the predetermined point to a specific edge of the sheet becomes a predetermined value and then rotate the sheet based on the amount of skew detected by the skew amount detecting unit to change an orientation of the sheet.

14 Claims, 26 Drawing Sheets

SHEET CONVEYING APPARATUS, SHEET CONVEYING METHOD, AND IMAGE FORMING APPARATUS

BACKGROUND OF THE INVENTION

1. Field of the Invention

The present invention relates to a method for conveying a cut sheet and to a sheet conveying apparatus controlled based on the sheet conveying method.

2. Description of the Related Art

In general, a printer apparatus conveys a printing sheet from a cassette (i.e., a sheet container) to a printing unit. As discussed in Japanese Patent Application Laid-Open No. 2005-306605, a printer apparatus can change the orientation of a sheet being separated and fed from a cassette by an angle of approximately 90 degrees before the sheet is conveyed to a printing unit.

The sheet conveying apparatus discussed in Japanese Patent Application Laid-Open No. 2005-306605 is simply described below with reference to FIGS. 28A to 28F, 29A to 29F, and 30.

In FIGS. 28A and 29A, a recording sheet supporting plate 104 shifts downward to press recording sheets against a sheet feeding roller 103. The sheet feeding roller 103 rotates in the clockwise direction so that a bottommost recording sheet can be conveyed rightward. A recording sheet positioned next to the bottommost recording sheet does not receive a pulling force from the sheet feeding roller 103. A separation friction member prevents the next recording sheet from being conveyed together with the bottommost recording sheet.

A recording sheet P, having being conveyed rightward, stops at a position where a leading edge of the sheet P reaches an orientation changing roller pair 105, whose rollers are in a separated state.

The orientation changing roller pair 105, as illustrated in FIG. 30, includes a pair of driving rollers 105*a* and 105*b* and a pair of driven rollers 105*c* and 105*d*, between which a recording sheet can be held. The driving roller 105*a* is independently driven by an orientation changing motor M1. The driving roller 105*b* is independently driven by an orientation changing motor M2.

The orientation changing motors M1 and M2, in a forward driving mode, rotate the driving rollers 105*a* and 105*b* in a clockwise direction. The driving rollers 105*a* and 105*b* cooperatively convey a recording sheet in a predetermined feeding direction. In this condition, the orientation changing roller pair 105 keeps rotating so that the bottommost recording sheet can be continuously conveyed in the sheet feeding direction and completely removed from a recording sheet container.

As illustrated in FIGS. 28B and 29B, a front half of the recording sheet P protrudes out of the apparatus body via an aperture 113.

Then, as illustrated in FIG. 29C, the sheet conveying apparatus adjusts the position of the recording sheet P in such a way that the orientation changing roller pair 105 can hold substantially the center of the recording sheet P in the sheet conveyance direction. To this end, the orientation changing motors M1 and M2 rotate in a forward direction or in a backward direction so that the distance between a leading edge of the recording sheet P and the holding point of the orientation changing roller pair 105 (i.e., D1 indicted in FIG. 29C) becomes equal to the distance between a trailing edge of the recording sheet P and the holding point of the orientation changing roller pair 105 (i.e., D2 indicated in FIG. 29C).

According to the illustrated example, the orientation changing motors M1 and M2 rotate in the backward direction so that the orientation changing roller pair 105 can hold substantially the center of the recording sheet P in the sheet conveyance direction. Thus, the recording sheet P is conveyed in a direction opposed to the sheet feeding direction and stops at the position illustrated in FIG. 29C.

Subsequently, as illustrated in FIG. 29D, the sheet conveying apparatus changes the orientation of the recording sheet P. In this case, rollers of a conveyance roller pair 106 are kept in a separated state. The orientation changing motors M1 and M2 drive the driving rollers 105*a* and 105*b* of the orientation changing roller pair 105 so as to rotate in mutually opposed directions as illustrated in FIG. 30. The driving rollers 105*a* and 105*b*, rotating in mutually opposed directions, can change the orientation of the recording sheet P in the interior space of the apparatus.

More specifically, the driving rollers 105*a* and 105*b* rotate a longer edge of the recording sheet P by 90 degrees relative to a direction perpendicular to the sheet conveyance direction. The driving rollers 105*a* and 105*b* stop rotating when the recording sheet P completes a rotating motion of approximately 90 degrees.

In the process of changing the orientation, the recording sheet P may reach the conveyance roller pair 106. The rollers of the conveyance roller pair 106 are required to be kept in a separated state. However, if the recording sheet P does not reach the conveyance roller pair 106 in the process of changing the orientation (i.e., when the dimension K indicated in FIG. 28D is sufficiently long), the rollers of the conveyance roller pair 106 can be kept in a pressed contact state.

Furthermore, in the process of changing the orientation, the recording sheet P causes a rotating (yawing) motion in a state where the recording sheet P partly protrudes out of the apparatus body via the aperture 113.

FIG. 29E illustrates the recording sheet P shifting leftward before being subjected to image forming processing. The sheet feeding roller 103 and the recording sheet supporting plate 104 can be kept in any state. At least one of the orientation changing roller pair 105 and the conveyance roller pair 106 is kept in a pressed contact state. In this state, the rollers of the orientation changing roller pair 105 or the conveyance roller pair 106 convey the recording sheet P to an image forming unit 120. The sheet conveying apparatus stops the above-described conveying operation when the leading edge of the recording sheet P reaches the image forming unit 120. In this case, either the orientation changing roller pair 105 or the conveyance roller pair 106 can convey the recording sheet P.

Furthermore, the sheet conveying apparatus performs a skew correction in such a way that the orientation of a side edge of the recording sheet P becomes parallel to the sheet conveyance direction. As illustrated in FIG. 29E, driven rollers 106*b* of the conveyance roller pair 106 are obliquely disposed relative to the sheet conveyance direction.

When the conveyance roller pair 106 conveys the recording sheet P along the conveyance path, a side edge of the recording sheet P is kept in contact with a reference wall 108 (i.e., a projection provided in the conveyance path). As a result, the side edge of the recording sheet P becomes parallel to the sheet conveyance direction. Such obliquely disposed rollers are generally referred to as "skewed rollers."

The technique for regulating the position/direction of a side edge of a recording sheet is discussed in Japanese Patent Application Laid-Open No. 8-208075 and Japanese Patent Application Laid-Open No. 7-334630.

When the driven rollers 106*b* of the conveyance roller pair 106 serve as the skewed rollers, the orientation changing roller pair 105 is kept in a separated state and does not interfere with the skewed rollers, which regulate the side edge of the recording sheet P shifting in parallel with the sheet conveyance direction.

As illustrated in FIG. 28F, the image forming unit 120 prints an image on the recording sheet P. Then, the sheet conveying apparatus discharges the recording sheet P from a sheet discharge port 114.

The above-described sheet conveying apparatus can reduce the body size, although a complicated mechanism for rotating a sheet is required.

However, according to the above-described sheet orientation changing method discussed in Japanese Patent Application Laid-Open No. 2005-306605, the rotating motion of a sheet tends to deteriorate sheet positioning accuracy.

FIG. 31 illustrates an exemplary operation of the above-described conventional sheet conveying apparatus that conveys the sheet illustrated in FIG. 29C straight and stops the sheet at a position where the rotation center of the sheet accords with a predetermined rotation center set in the apparatus.

Although not described in Japanese Patent Application Laid-Open No. 2005-306605, the control for positioning a sheet advancing straight can be performed based on a closed loop control using a sheet detecting sensor provided on a sheet conveyance path.

In FIG. 31, "A" indicates a recording sheet having been conveyed accurately without causing any skew, and "B" indicates a recording sheet inclined relative to the correct orientation. For example, the sheet conveying apparatus stops the sheet based on a closed loop control using a sensor 140 as illustrated in FIG. 31. The distance L from a rotation center C to the sensor 140 is not different between the sheet A and the sheet B, which are stopped at the position being detected by the sensor 140.

FIG. 32 illustrates a sheet rotating operation performed by the sheet conveying apparatus. In FIG. 32, "R" represents a rotation radius of the sheet A (i.e., the distance from the rotation center C to the edge of the sheet A), and "r" represents a rotation radius of the sheet B (i.e., the distance from the rotation center C to the edge of the sheet B). The rotation radius "r" of the sheet B is smaller than the rotation radius "R" of the sheet A.

The orientation changing roller pair 105 does not include any mechanism for correcting the difference between the rotation radii R and r. FIG. 33 illustrates a positional deviation R-r between left edges of the sheet A and the sheet B. The orientation changing roller pair 105 cannot shift the sheet in the right-and-left direction. Therefore, the positional deviation R-r caused in this manner may deteriorate sheet positioning accuracy. In other words, the above-described conventional sheet conveying apparatus has inaccuracy in positioning a rotated sheet.

As a method for regulating the left edge of a rotated sheet, it is useful to provide the "skewed rollers" that can pull the sheet in the right-and-left direction and convey the sheet along a reference plate provided on the sheet conveyance path, as discussed in the above-described Japanese Patent Application Laid-Open No. 8-208075 and Japanese Patent Application Laid-Open No. 7-334630.

However, the mechanism including the "skewed rollers" requires a significantly long conveyance path for completely regulating the position/orientation of a sheet while the sheet is conveyed along the sheet conveyance path. Thus, the "skewed rollers" cannot be used for a sheet conveying apparatus that is required to reduce the body size.

SUMMARY OF THE INVENTION

Exemplary embodiments of the present invention are directed to a sheet conveying apparatus capable of accurately positioning a sheet having being subjected to a rotating operation and capable of downsizing the apparatus body.

According to an aspect of the present invention, a sheet conveying apparatus includes a skew amount detecting unit configured to detect an amount of skew of a sheet; two rollers configured to convey the sheet in a predetermined conveyance direction when rotating in a same direction and to rotate the sheet around a predetermined point when rotating in mutually different directions; and a control unit configured to control the two rollers such that the two rollers convey the sheet to a position where a distance from the predetermined point to a specific edge of the sheet becomes a predetermined value and then rotate the sheet based on the amount of skew detected by the skew amount detecting unit to change an orientation of the sheet.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, and features of the invention and, together with the description, serve to explain at least some of the principles of the invention.

DETAILED DESCRIPTION OF THE EMBODIMENTS

Figure 1:
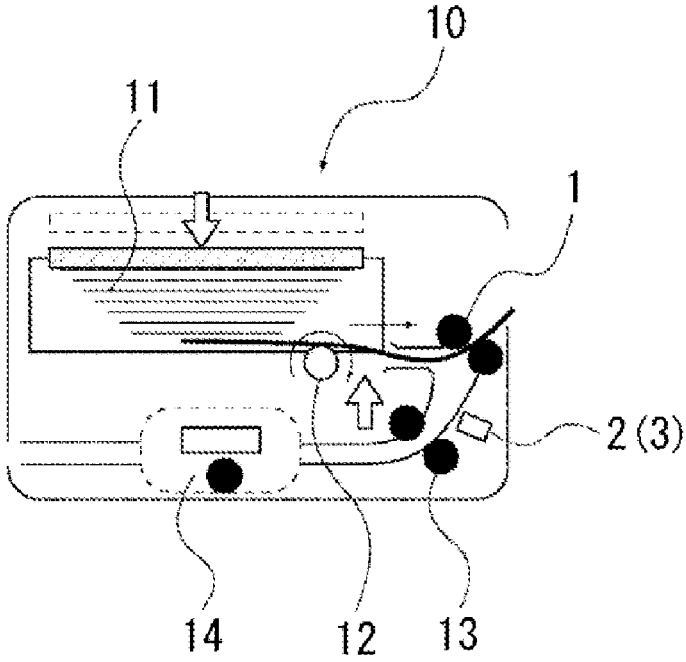
FIG. 1 is a cross-sectional diagram illustrating an image forming apparatus including a sheet conveying apparatus according to a first exemplary embodiment of the present invention.

The following description of exemplary embodiments is illustrative in nature and is in no way intended to limit the invention, its application, or uses.

Processes, techniques, apparatus, and systems as known by one of ordinary skill in the art are intended to be part of the enabling description where appropriate.

It is noted that throughout the specification, similar reference numerals and letters refer to similar items in the following figures, and thus once an item is described in one figure, it may not be discussed for following figures.

Exemplary embodiments will be described in detail below with reference to the drawings.

First Exemplary Embodiment

FIG. 1 illustrates an image forming apparatus including a sheet conveying apparatus according to a first exemplary embodiment of the present invention.

The image forming apparatus illustrated in FIG. 1 includes a printer body 10, a cassette 11 serving as a container configured to store a plurality of sheets, and a feeding roller 12 configured to feed a sheet from the cassette 11.

An orientation changing roller pair (i.e., an orientation changing unit or a rotating unit) 1 receives a sheet supplied from the feeding roller 12 and conveys the sheet in a predetermined conveyance direction. The orientation changing roller pair 1 can cause a switchback motion of the sheet and then cause a rotating motion of the sheet so as to change the orientation of the sheet.

Figure 11:
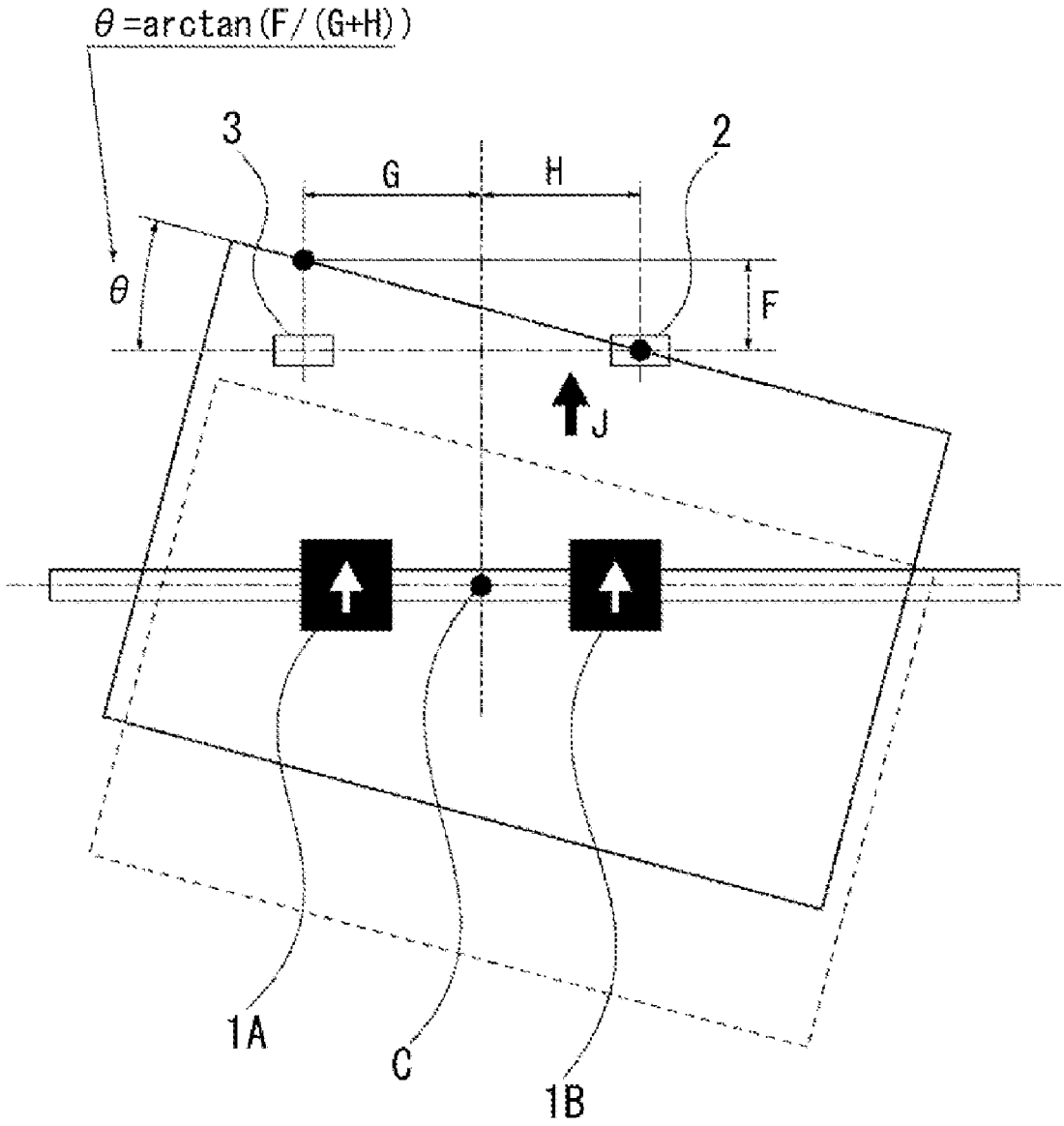
FIG. 11 illustrates an operation of the sheet conveying apparatus according to the first exemplary embodiment.

The orientation changing roller pair 1 includes rollers 1A and 1B aligned along a line perpendicular to a predetermined conveyance direction (i.e., the direction indicated by arrow J) as illustrated in FIG. 11. The rollers 1A and 1B have a common rotational axis perpendicular to the predetermined conveyance direction. The rollers 1A and 1B can be driven independently. The rollers 1A and 1B, when rotating in mutually opposite directions, can rotate a sheet around an axis perpendicular to the surface of the sheet to change the orientation of the sheet.

Two sensors 2 and 3, capable of detecting a sheet, and a later-described control unit cooperatively constitute a skew amount detecting unit configured to detect an amount of skew of the sheet.

A conveyance roller pair 13 serves as a conveying unit configured to convey a sheet supplied from the orientation changing roller pair 1. The rollers 1A and 1B can also function as the conveying unit. An image forming unit 14 prints an image on a sheet conveyed by the conveyance roller pair 13.

Figure 3:
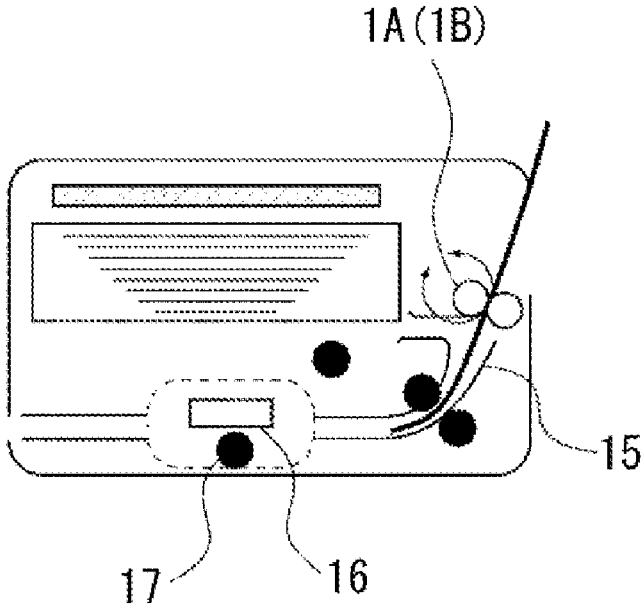
FIG. 3 is a cross-sectional diagram illustrating an operation of the sheet conveying apparatus according to the first exemplary embodiment.

The image forming unit 14 includes a recording head 16 and a platen roller 17 (FIG. 3).

Figure 9:
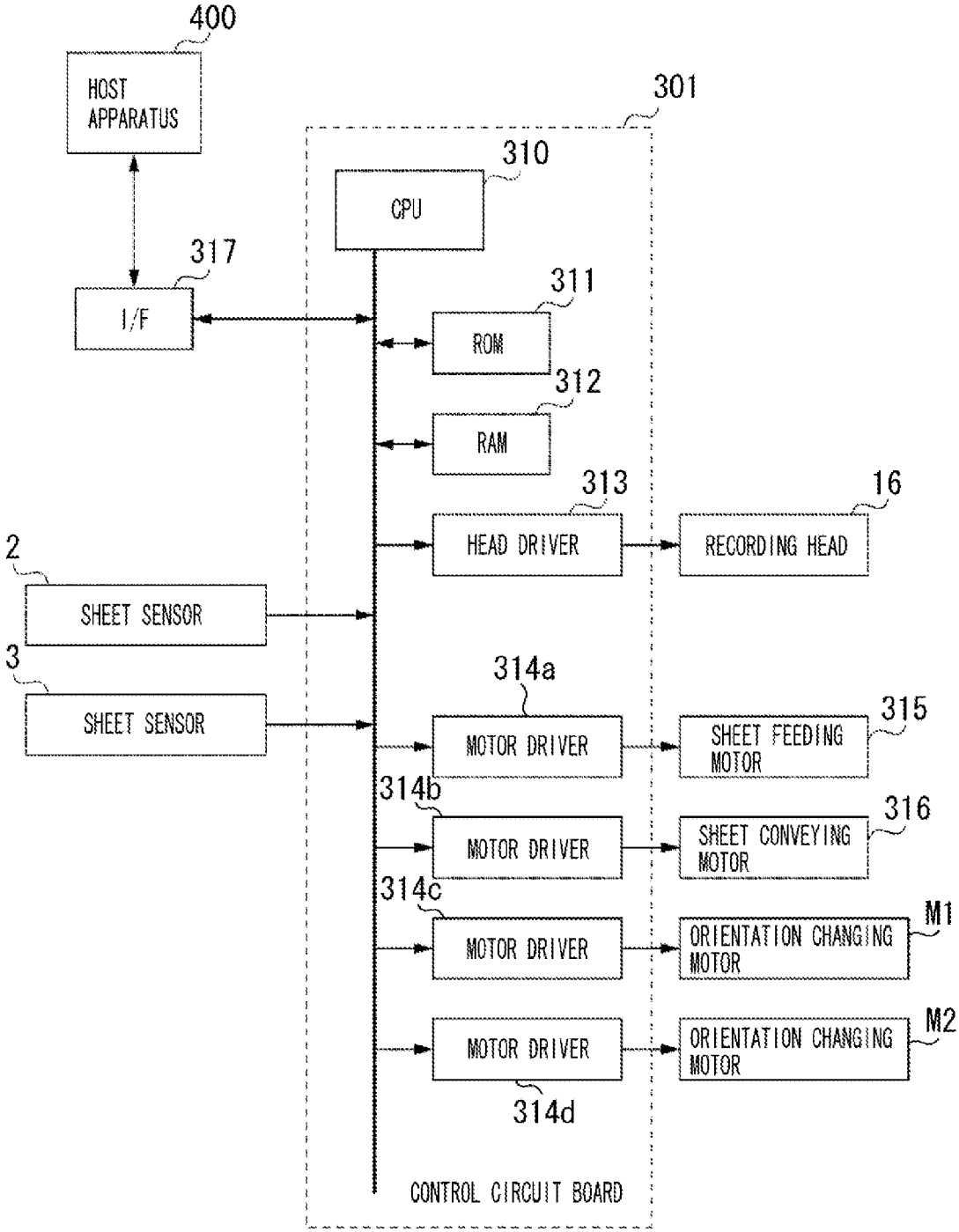
FIG. 9 is a control block diagram of the sheet conveying apparatus according to the first exemplary embodiment.

FIG. 9 is a control block diagram of the image forming apparatus according to the first exemplary embodiment.

In FIG. 9, a control circuit board 301 is a control unit configured to control the image forming apparatus. The control circuit board 301 includes a central processing unit (CPU) 310 configured to generate various control commands, a read-only memory (ROM) 311 configured to store control data or other data, and a random access memory (RAM) 312 configured to serve as a region for expanding or rasterizing recorded data. The control circuit board 301 and the above-described sensors 2 and 3 can cooperatively constitute a later-described measuring unit.

A head driver 313 drives the recording head 16. A first motor driver 314*a* drives a sheet feeding motor 315. A second motor driver 314*b* drives a sheet conveying motor 316. A third motor driver 314*c* drives an orientation changing motor M1. A fourth motor driver 314*d* drives an orientation changing motor M2. An interface 317 performs transmission/reception of data between the control circuit board 301 and a host apparatus 400 (e.g., a computer or a digital camera).

An operation of the image forming apparatus according to the first exemplary embodiment is described below with reference to the illustration of FIGS. 1 through 9 and a flowchart of FIG. 10.

Figure 2:
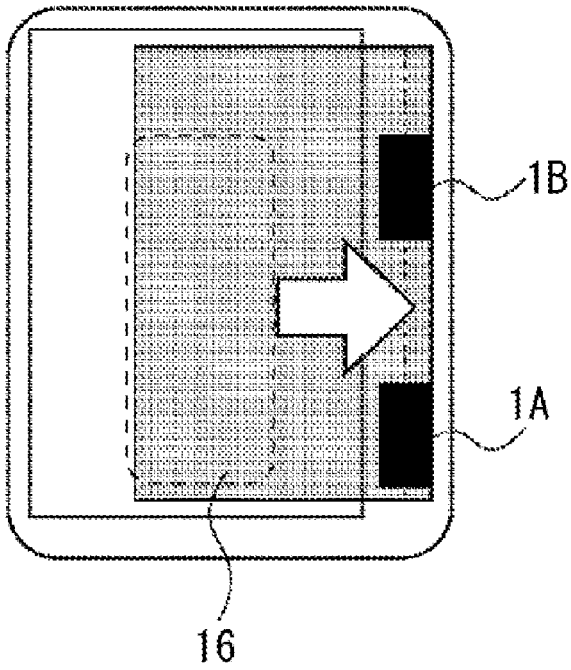
FIG. 2 is a plan diagram illustrating the sheet conveying apparatus according to the first exemplary embodiment.
Figure 10:
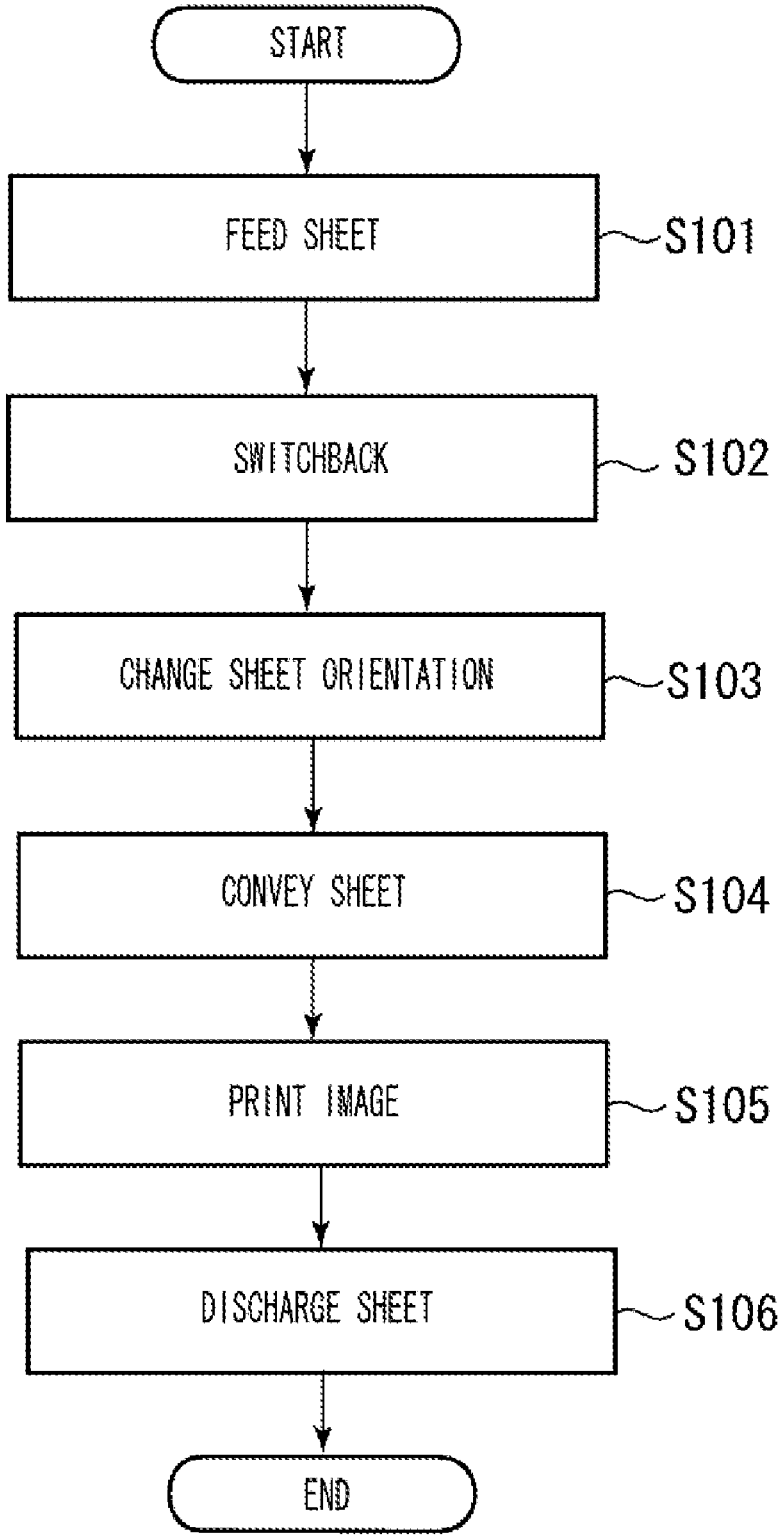
FIG. 10 is a flowchart illustrating an operation of the sheet conveying apparatus according to the first exemplary embodiment.

In step S101 (i.e., sheet feeding step) of FIG. 10, the CPU 310 causes the sheet feeding motor 315 to rotate the feeding roller 12 in the clockwise direction. The bottommost sheet of a plurality of sheets in the cassette 11 is conveyed rightward by the feeding roller 12 as illustrated in FIG. 1. The sheet is further conveyed rightward by the orientation changing rollers 1A and 1B rotating in the same direction, which are driven by the orientation changing motors M1 and M2 (FIG. 2).

Figure 4:
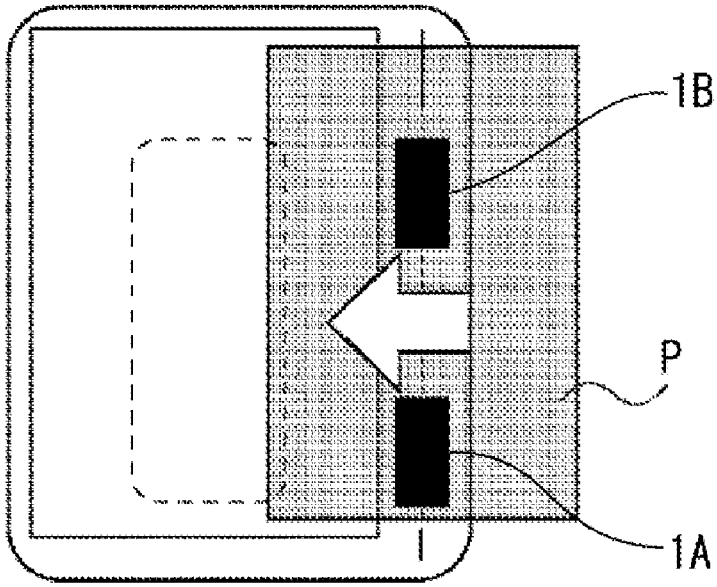
FIG. 4 is a plan diagram illustrating an operation of the sheet conveying apparatus according to the first exemplary embodiment.

In step S102 (i.e., switchback step), the CPU 310 causes the orientation changing motors M1 and M2 to rotate in the opposite direction. The sheet is conveyed in a direction opposed to the sheet feeding direction, as illustrated in FIGS. 3 and 4. The leading edge of the sheet enters a conveyance path 15.

In step S103 (i.e., sheet orientation changing step), the CPU 310 causes the orientation changing motors M1 and M2 to rotate in mutually opposite directions. The orientation changing roller 1B (positioned at a far side in FIG. 5) rotates in the clockwise direction, and the orientation changing roller 1A (positioned at a near side in FIG. 5) rotates in the counterclockwise direction.

Figure 6:
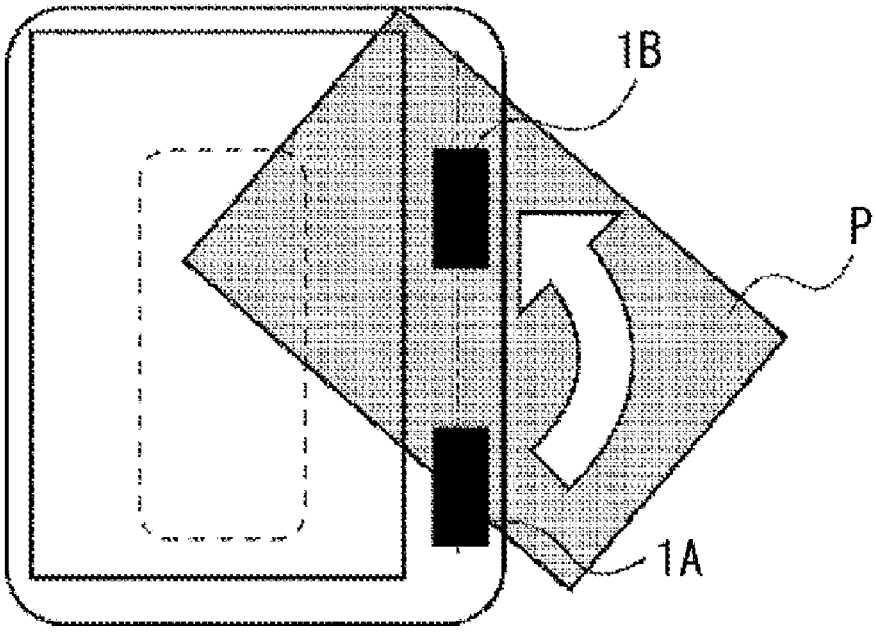
FIG. 6 is a plan diagram illustrating an operation of the sheet conveying apparatus according to the first exemplary embodiment.

The orientation changing rollers 1A and 1B, having a common rotational axis, rotate in mutually opposed directions. The sheet P rotates in the counterclockwise direction around an intermediate point between the rollers 1A and 1B as illustrated in FIG. 6. Thus, the sheet P changes its orientation.

As illustrated in FIG. 4, in a condition where the sheet P is not yet rotated, a shorter edge of the sheet P is parallel to the sheet conveyance direction indicated by an arrow.

The above-described orientation changing operation can change the orientation of the sheet P in such a way that a longer edge of the sheet P becomes parallel to the sheet conveyance direction. When the sheet P is rotating, the conveyance roller pair 13 is kept in a separated state. Therefore, the conveyance roller pair 13 does not hold the sheet P.

Figure 7:
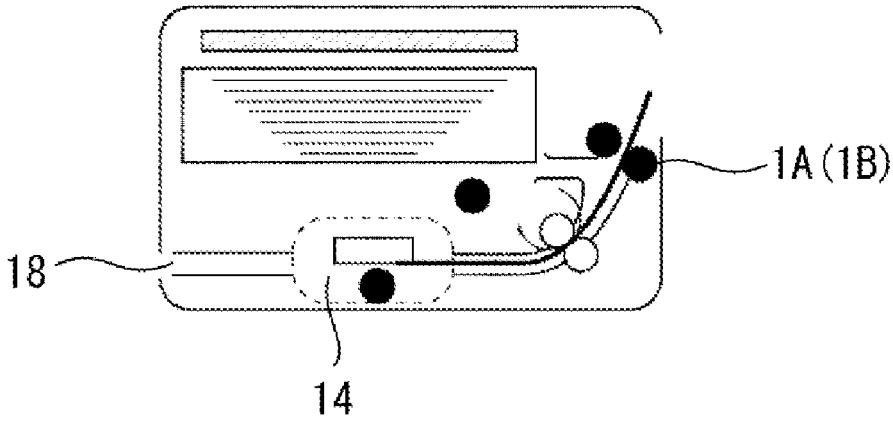
FIG. 7 is a cross-sectional diagram illustrating an operation of the sheet conveying apparatus according to the first exemplary embodiment.
Figure 8:
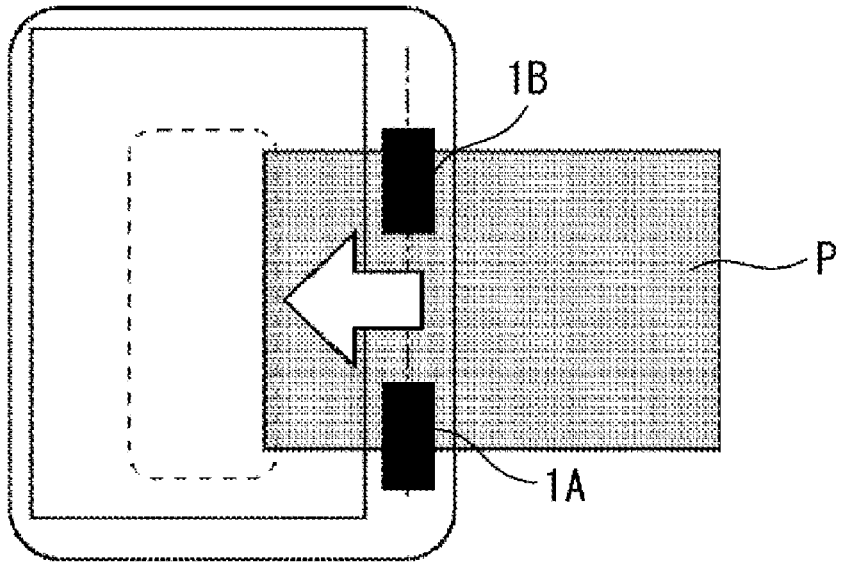
FIG. 8 is a plan diagram illustrating an operation of the sheet conveying apparatus according to the first exemplary embodiment.

In step S104 (i.e., conveyance step), the conveyance roller pair 13 holds the sheet P. The orientation changing roller pair 1 and the conveyance roller pair 13 cooperatively convey the sheet P toward the image forming unit 14 (FIGS. 7 and 8).

In step S105, when the leading edge of the sheet P reaches the image forming unit 14, the CPU 310 causes the recording head 16 to perform a recording operation to form an image on the sheet P based on an image signal.

After the recording head 16 starts the recording operation, the leading edge of the sheet P exits from a discharge port 18.

In step S106, a discharging unit (not illustrated) discharges the sheet P from the discharge port 18 when the recording head 16 completes the recording operation.

As described above, the orientation of the sheet P changes 90 degrees from the condition where the sheet P is stored in the cassette 11 to the condition where the image is formed on the sheet P. Thus, the exemplary embodiment can facilitate downsizing the apparatus body.

More specifically, the image forming unit 14 includes a driving mechanism attached to the side thereof. The length of the image forming unit 14 in a direction perpendicular to the sheet conveyance direction is longer than that in the sheet conveyance direction. Therefore, in order to downsize the apparatus body, it is useful to convey the sheet P in the direction parallel to the longer edge thereof when the sheet P passes the image forming unit 14.

The longer edge of the sheet P is longer than the length of the image forming unit in the conveyance direction. Therefore, when the image forming unit 14 and the sheet container (cassette 11) are disposed in an overlapped state, the apparatus body can be downsized if a shorter edge of a sheet in the sheet container is disposed in parallel with the sheet conveyance direction in the image forming unit 14. To this end, it is required to change the orientation of each sheet by 90 degrees, compared to the sheet stored in the sheet container, before the sheet reaches the image forming unit 14.

Next, the orientation changing operation performed in step S103 is described in more detail.

FIG. 11 illustrates an exemplary operation for conveying the sheet P straight in a predetermined conveyance direction, along the conveyance path 15, toward the image forming unit 14 and stopping the sheet P at a position where the rotation center of the sheet P accords with the rotation center in the apparatus. The orientation changing rollers 1A and 1B, when rotating in mutually opposed directions, cause the sheet P to rotate around an axis perpendicular to the surface of the sheet P. The sheet P intersects with such an axis at a point C. The point C is referred to as a "rotation center" in the present embodiment.

Similar to the above-described conventional apparatus, to convey a sheet straight and position the sheet at a designated point, it is useful to perform a closed loop control based on a signal obtained from a sheet detecting sensor provided on the sheet conveyance path.

The present exemplary embodiment uses two sensors 2 and 3 (i.e., a first sheet detecting sensor and a second sheet detecting sensor). When the leading edge (i.e., specific edge) of the sheet shifts across two sensors 2 and 3, a time difference in sheet passage detection is measured by the measuring unit including the control unit and the sensors 2 and 3. Furthermore, the measuring unit obtains a distance F based on a product of the measured time difference and a sheet conveyance speed, and calculates an inclination angle θ based on the formula described in FIG. 11.

According to the example illustrated in FIG. 11, two sensors 2 and 3 are aligned in a direction perpendicular to the sheet conveyance direction. If the sensors 2 and 3 are out of alignment by a shift length in the sheet conveyance direction, such a shift length can be obtained beforehand as a known constant value. Thus, the inclination of a sheet can be obtained by simply adding or subtracting the known constant value (i.e., shift amount) to or from the calculated inclination.

Figure 12:
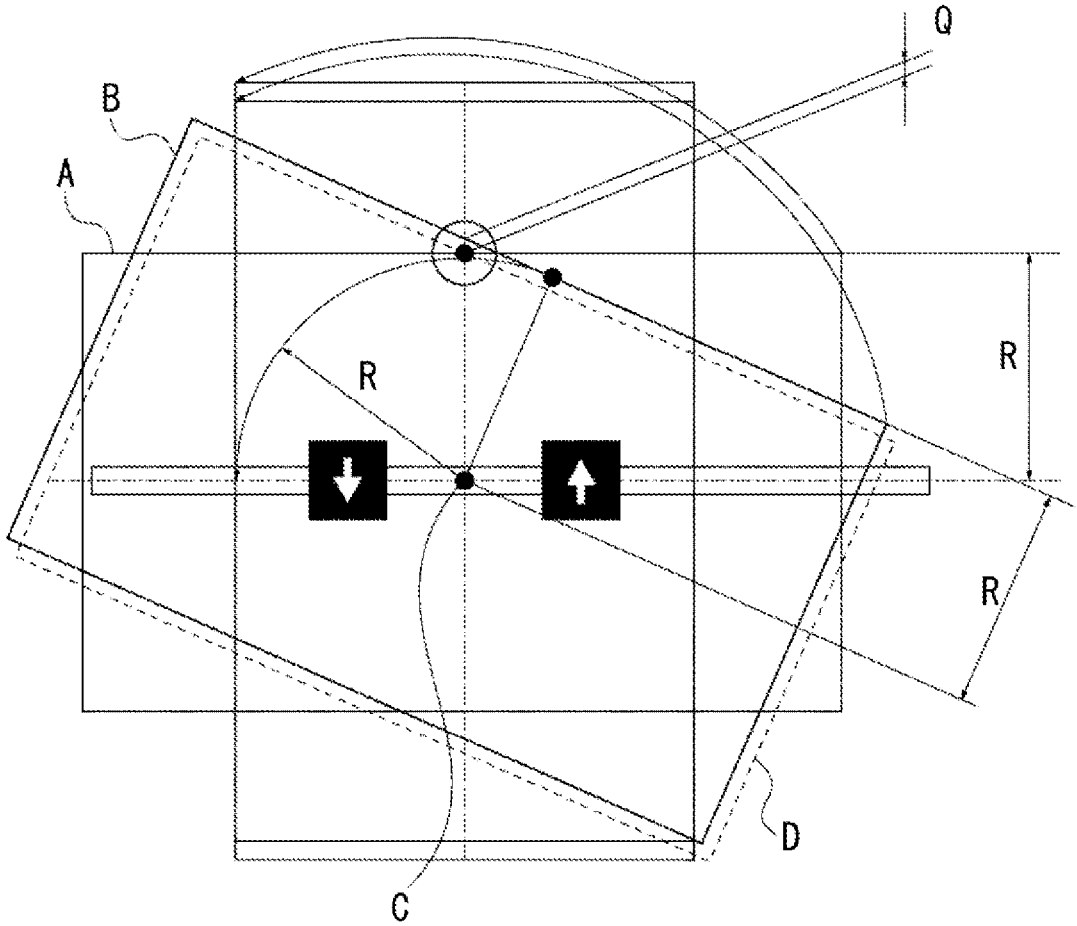
FIG. 12 illustrates an operation of the sheet conveying apparatus according to the first exemplary embodiment.
Figure 31:
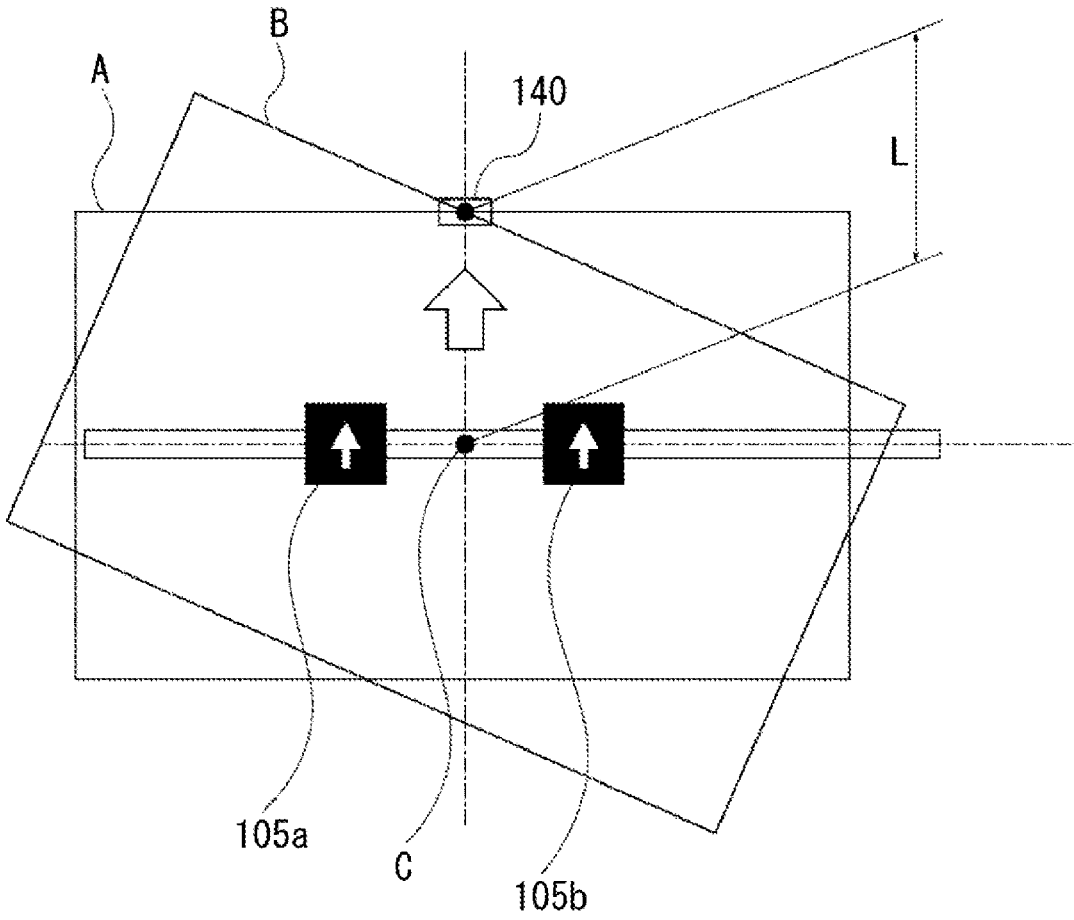
FIG. 31 PRIOR ART
FIG. 31 illustrates an operation of a conventional sheet conveying apparatus.
Figure 32:
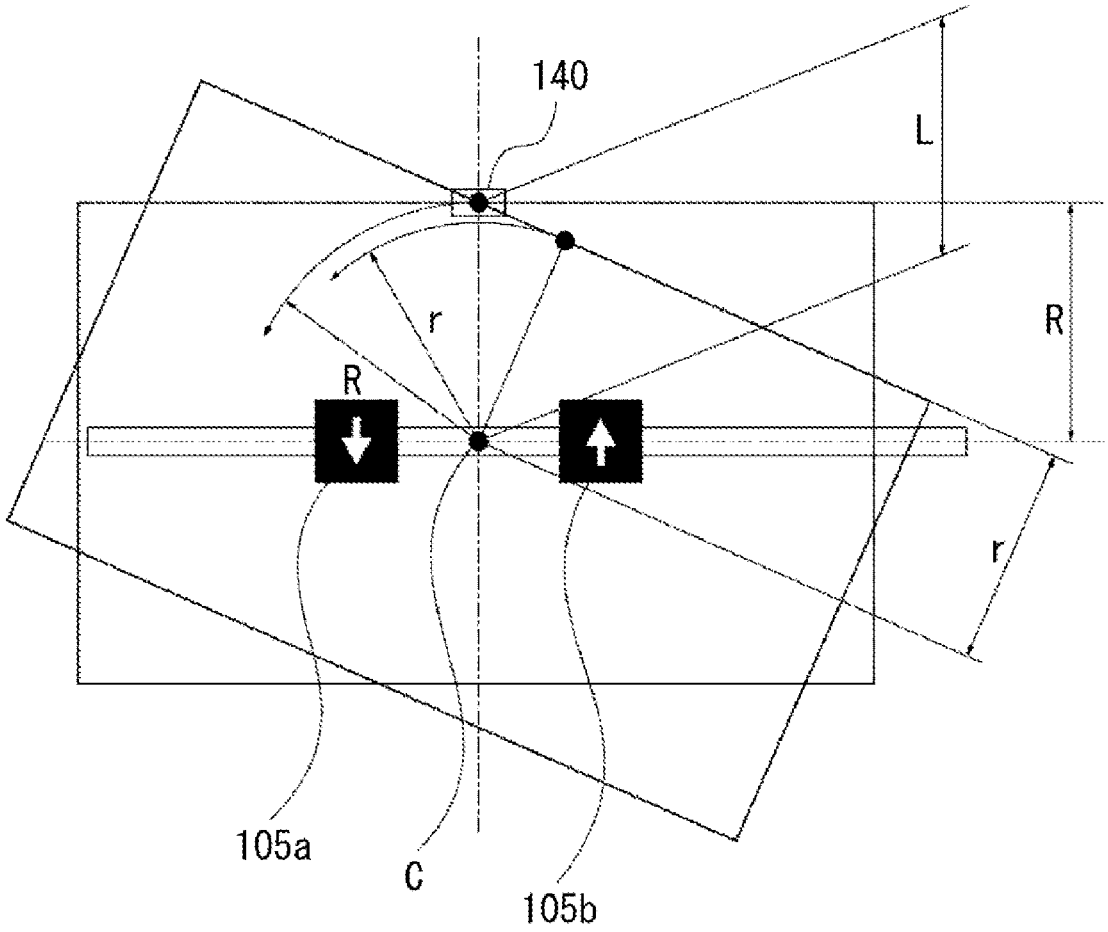
FIG. 32 PRIOR ART
FIG. 32 illustrates an operation of a conventional sheet conveying apparatus.
Figure 33:
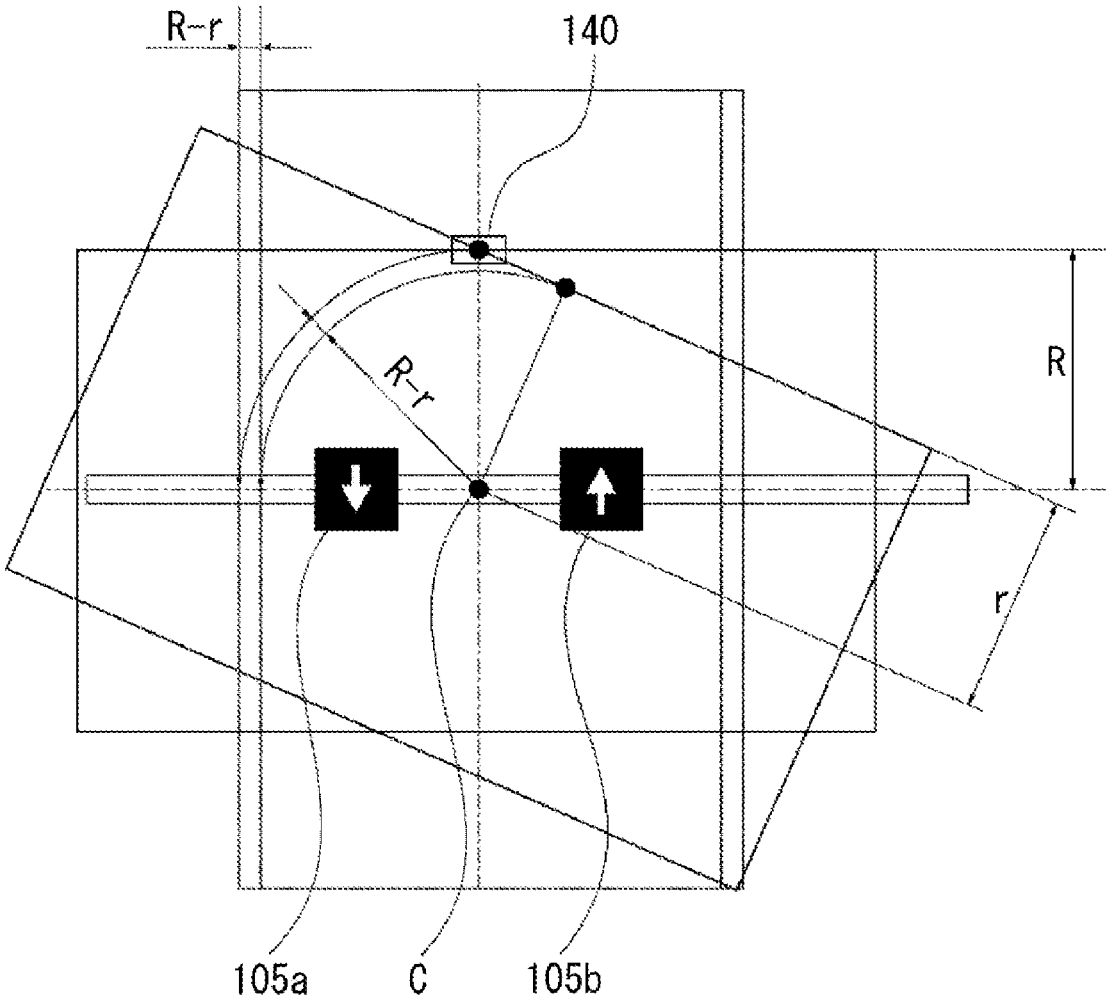
FIG. 33 PRIOR ART
FIG. 33 illustrates an operation of a conventional sheet conveying apparatus.

FIG. 12 illustrates an exemplary operation of the sheet conveying apparatus according to the present exemplary embodiment, which conveys a recording sheet straight and stops the sheet at a desired point. In FIG. 12, "A" indicates a sheet having been conveyed accurately without causing any skew, and "B" indicates a sheet inclined relative to the correct orientation. Furthermore, "D" indicates a conventional example corresponding to the sheet B illustrated in FIG. 31. The sheet "B" has been further conveyed by a correction distance Q compared with the sheet "D".

In other words, the sheet conveying apparatus according to the present exemplary embodiment changes the stop position of a sheet depending on the inclination of the sheet. More specifically, the sheet conveying apparatus calculates the correction distance Q based on the inclination of the sheet and continuously conveys the sheet after the sensor has detected the sheet until a leading edge of the sheet reaches the correction distance Q. The control unit can operate as a calculation unit configured to perform the above-described calculation.

Through the above-described correction, the distance from a predetermined rotation center C to the leading edge (i.e., specific edge) of the sheet A and the distance from the rotation center C to the leading edge of the sheet B become equal to the same distance "R" (predetermined value).

FIG. 12 illustrates the sheets A and B being rotated around the rotation center C with the leading edges keeping the same distance R from the rotation center C. The left edges of the rotated sheets A and B can be accurately positioned along the same line.

Figure 13:
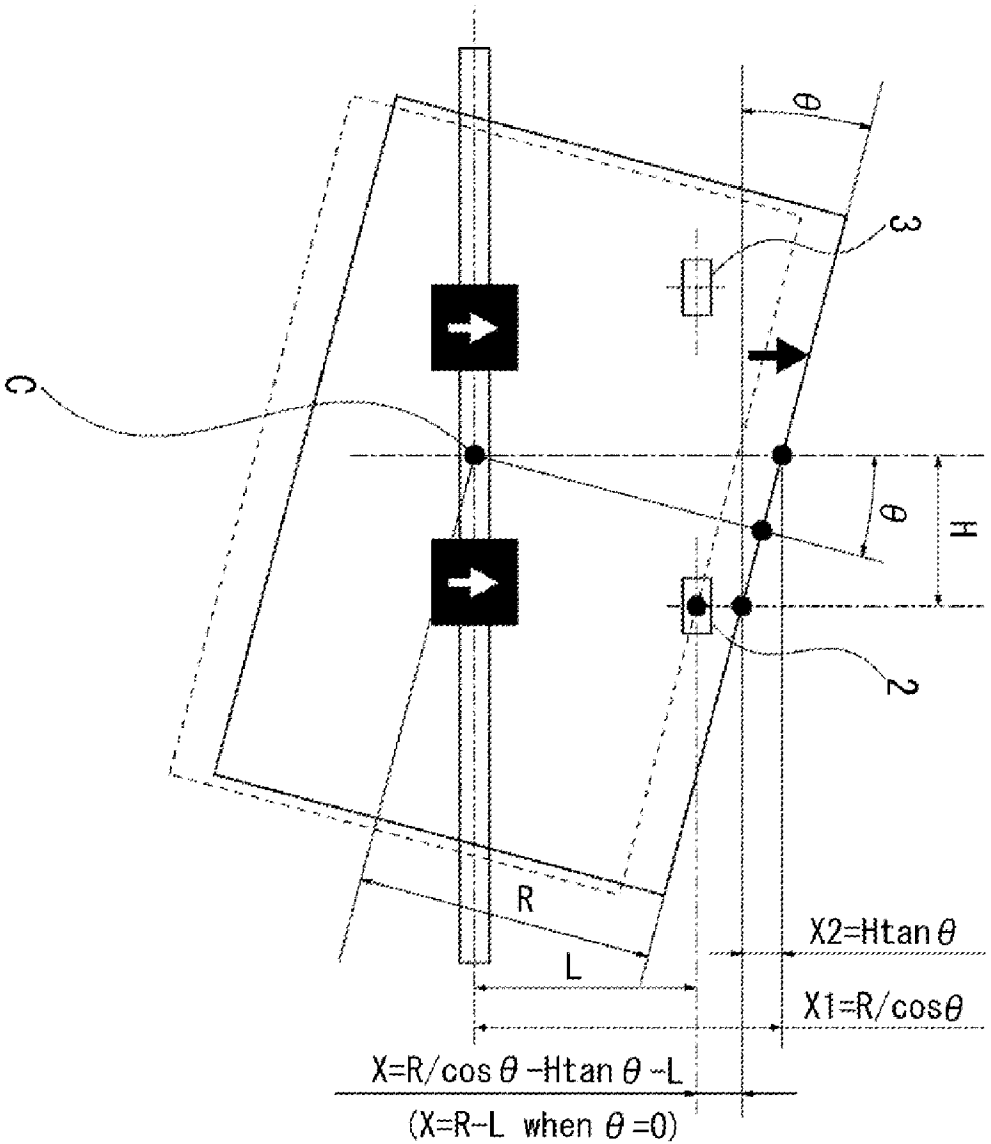
FIG. 13 illustrates an operation of the sheet conveying apparatus according to the first exemplary embodiment.

FIG. 13 illustrates an exemplary method for calculating the correction distance Q based on the inclination of a sheet being stopped. As illustrated in FIG. 13, θ indicates the inclination angle of a sheet, H represents the distance between the sensor 2 and the rotation center C in the right-and-left (horizontal) direction, and L represents the distance between the sensor 2 and the rotation center C in the up-and-down (vertical) direction. The stop position of the sheet deviates from the sensor 2 by a distance "X=R/cos θ−H tan θ−L."

When the sheet having passed the sensor 2 is stopped at the distance X, the sheet can be rotated around the rotation center C with the radius R from the rotation center C to the leading edge of the sheet, regardless of the inclination of the sheet.

If a sheet is conveyed accurately, the sheet has no inclination (θ=0). In this case, the value X (i.e., a reference conveyance amount of a sheet having passed the sensor 2) can be obtained based on the following formula.

$$X=R-L$$

If the sheet inclines from the above-described reference position, the conveyance amount X can be obtained based on the following formula.

$$X=R/\cos\theta-H\tan\theta-L$$

A correction amount ΔX for the conveyance amount X is equal to the difference between the above-described values and can be obtained based on the following formula.

$$\Delta X=R/\cos\theta-H\tan\theta-R$$

The above-described calculations are applicable to any angle θ regardless of the sign (plus or minus) of the angle θ, as understood from the principle of trigonometric functions.

Figure 14:
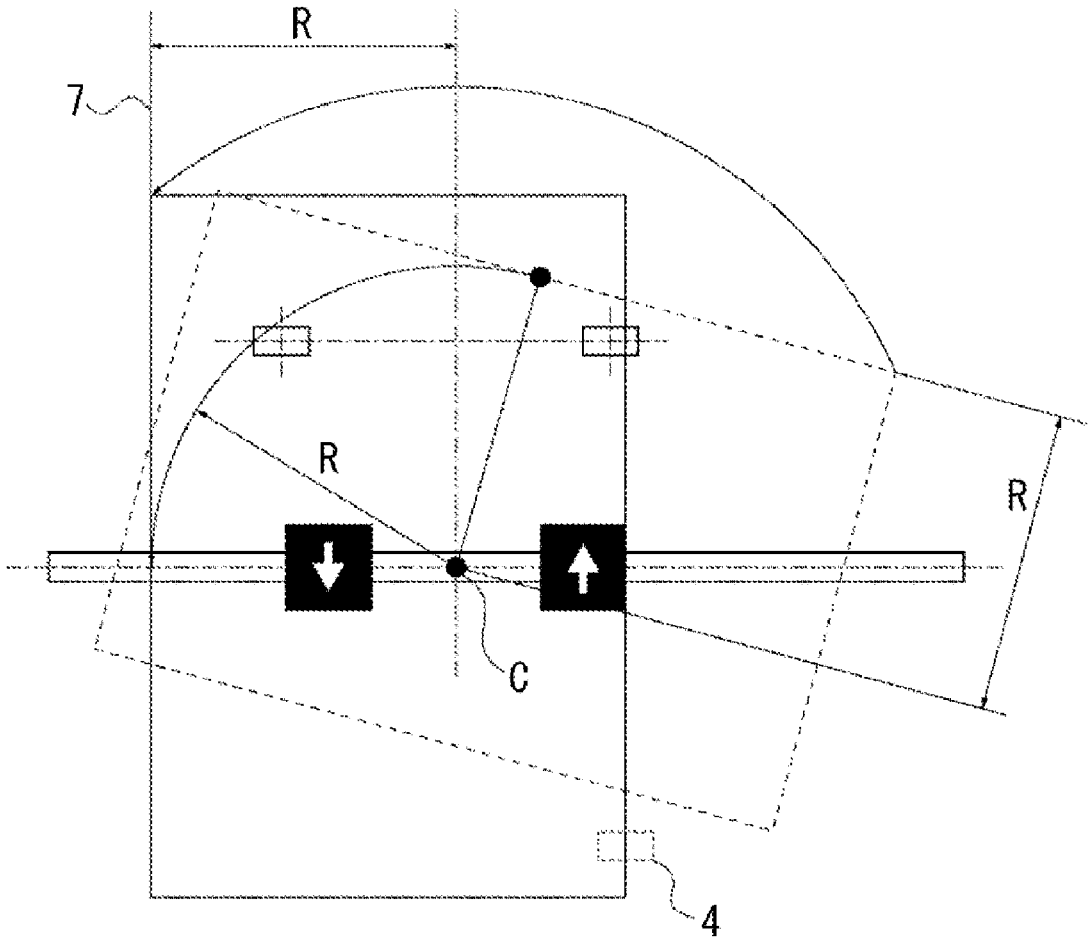
FIG. 14 illustrates an operation of the sheet conveying apparatus according to the first exemplary embodiment.

The sheet conveying apparatus according to the present exemplary embodiment can perform a closed loop control for adjusting the stop position of a sheet based on a correction value calculated based on the inclination of the sheet. Thus, as illustrated in FIG. 14, a recording sheet can be constantly rotated with the same radius R regardless of the inclination of the sheet. As a result, the sheet conveying apparatus according to the present exemplary embodiment can accurately position the left edge of any inclined sheet.

Compared to the conventional technique using the skewed rollers, the sheet conveying apparatus according to the present exemplary embodiment requires a relatively small space for rotating a sheet and, therefore, can reduce the body size.

Figure 16:
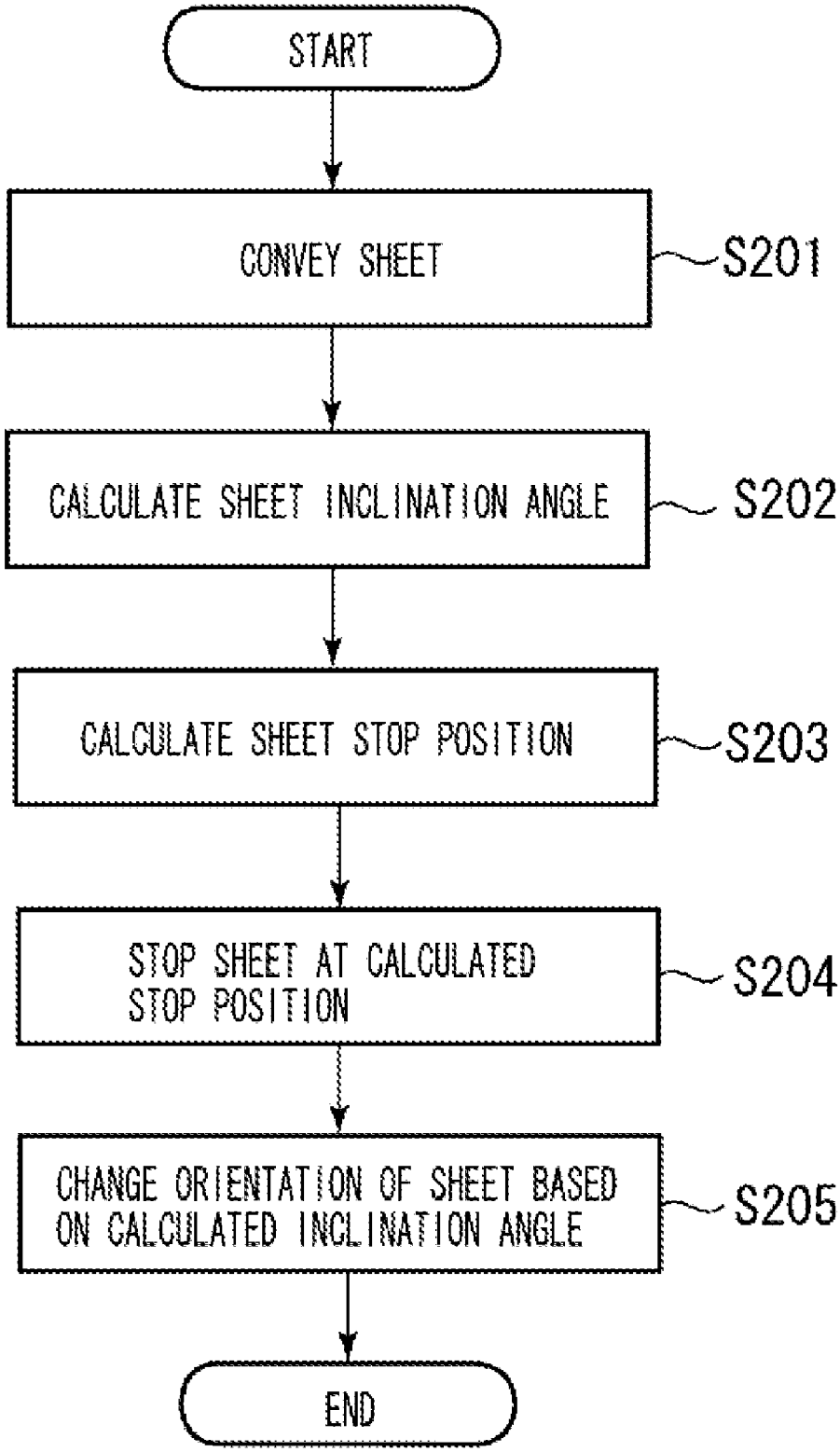
FIG. 16 is a flowchart illustrating a sheet rotating operation of the sheet conveying apparatus according to the first exemplary embodiment.

FIG. 16 is a flowchart illustrating an exemplary operation of the sheet conveying apparatus, which adjusts the orientation and the side edge of the sheet P being rotated as described above.

Figure 5:
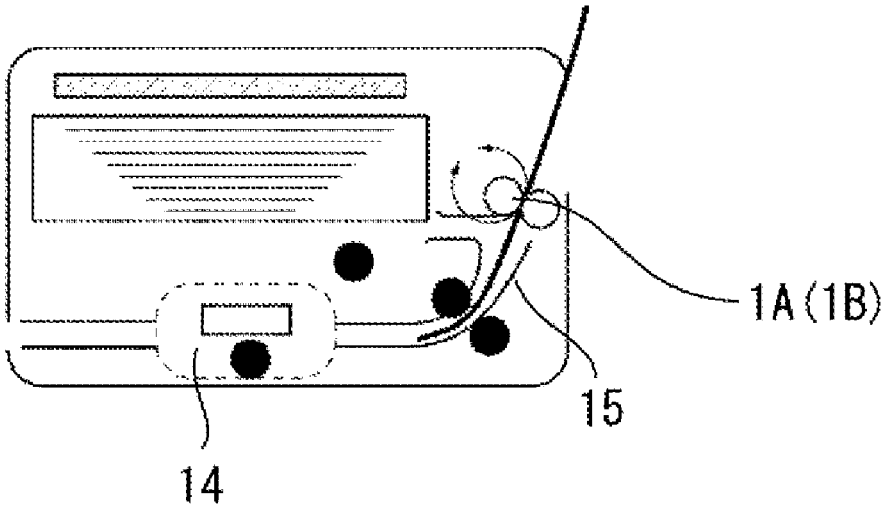
FIG. 5 is a cross-sectional diagram illustrating an operation of the sheet conveying apparatus according to the first exemplary embodiment.

In step S201, the orientation changing motors M1 and M2 rotate the orientation changing rollers 1A and 1B in the clockwise direction in FIG. 5. The sheet P is conveyed straight along the conveyance path 15 toward the image forming unit 14.

In step S202, the CPU 310 calculates the inclination of the sheet P (i.e., an amount of skew) based on the time difference between two sensors 2 and 3, which detect the leading edge of the sheet P. More specifically, T represents a time difference between the sensor 3 detecting the leading edge of the sheet P and the sensor 2 detecting the leading edge of the sheet P, and V represents a sheet conveyance speed. The CPU 310 can obtain a shifting distance F of the sheet P being conveyed during the time T based on the following formula.

$$F=VT$$

When G+H represents the distance between two sensors 2 and 3, the CPU 310 can calculate the inclination angle θ of the sheet P based on the following formula.

$$\theta=\arctan(F/(G+H))$$

In step S203, the CPU 310 calculates the stop position of the sheet P. The sheet stop position is a reference position where, when the sheet P rotates around the rotation center C, the leading edge of the sheet P can be positioned along a side edge reference line 7 (FIG. 14).

Namely, as illustrated in FIG. 14, when the distance from the rotation center C to the side edge reference line 7 is equal to the predetermined value "R", the sheet conveying apparatus stops the sheet P at the moment the leading edge of the sheet P reaches a position distant from the rotation center C by the distance R.

It is now assumed that L represents the distance from the rotation center C to the sensor 2 or 3 in the conveyance direction.

Furthermore, X1 represents a distance by which the sheet P is conveyed until the leading edge of the sheet P reaches the stop position after passing the rotation center C. The CPU 310 can calculate the distance X1 based on the following formula.

$$X1=R/\cos\theta$$

It is further assumed that a leading edge point of the sheet P having passed the rotation center C is positioned at a distance X2 downstream of a leading edge point of the sheet P having passed the sensor 2. The CPU 310 can calculate the distance X2 based on the following formula.

$$X2=H\tan\theta$$

The sheet conveying apparatus continuously conveys the sheet P after the sensor 2 has detected the leading edge of the sheet P and stops the sheet P when the sheet P has been conveyed by the distance X. The CPU 310 can calculate the distance X based on the following formula.

$$X=X1-X2-L=R/\cos\theta-H\tan\theta-L$$

In step S203, the CPU 310 calculates the distance X, which represents the stop position of the sheet being conveyed after the sensor 2 has detected the leading edge of the sheet P, based on the above-described calculation.

In step S204, the sheet conveying apparatus conveys and stops the sheet P at the stop position.

In step S205, the CPU 310 causes the orientation changing motors M1 and M2 to rotate in mutually opposite directions. The orientation changing roller 1B (positioned at a far side in FIG. 5) rotates in the clockwise direction, and the orientation changing roller 1A (positioned at a near side in FIG. 5) rotates in the counterclockwise direction.

The CPU 310 stops the orientation changing motors M1 and M2 when the sheet P completes a rotating (yawing) motion corresponding to a rotational angle calculated based on the following formula.

$$\pi/2+\theta$$

With the above-described operation, the sheet conveying apparatus completes an operation for adjusting the orientation and the side edge position of the sheet P.

In the rotating operation of the sheet P, if the orientation changing roller 1A and the orientation changing roller 1B rotate in opposite directions at the same conveyance speed, the distance from the rotation center C of the sheet P to the orientation changing roller 1A is equal to the distance from the rotation center C of the sheet P to the orientation changing roller 1B. However, if the rollers 1A and 1B rotate at mutually different speeds, the rotation position C can deviate from the above-described position depending on a speed ratio between the rollers 1A and 1B.

In the present exemplary embodiment, two sensors are aligned in a direction perpendicular to the sheet conveyance direction. If the sensors deviate from each other in the sheet conveyance direction, such a deviation can be obtained beforehand as a known constant value. Thus, the inclination of a sheet can be obtained by simply adding or subtracting the known constant value (i.e., deviation) to or from the calculated inclination.

The sheet conveying apparatus according to the above-described exemplary embodiment rotates the sheet P in the counterclockwise direction. However, the rotating direction is not limited to the counterclockwise direction. For example, the sheet conveying apparatus can rotate the sheet P in the clockwise direction and locate the right edge of the sheet P along a reference line.

In the present exemplary embodiment, it is useful to provide a sensor at a position 4 indicated in FIG. 14 to accurately stop the rotating motion of the sheet based on the closed loop control.

Figure 15:
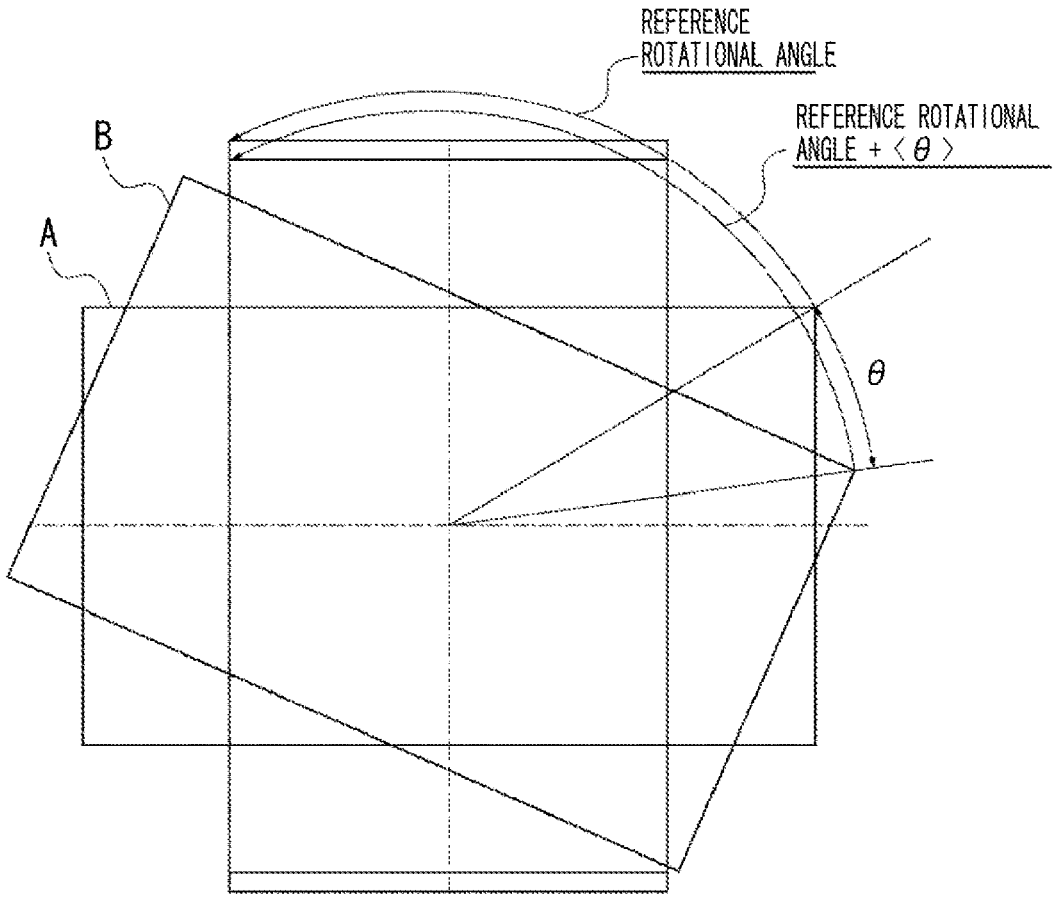
FIG. 15 illustrates an operation of the sheet conveying apparatus according to the first exemplary embodiment.

However, the apparatus can perform an open loop control if the control accuracy is satisfactory. FIG. 15 illustrates a rotation angle of the sheet, which is rotated based on an open loop control. In FIG. 15, "A" indicates a sheet having been conveyed accurately without causing any skew, and "B" indicates a sheet inclined relative to the correct orientation.

To improve the positioning accuracy in the open loop control, it is useful to rotate the sheet B by a rotational angle corresponding to a sum of a rotational angle of the sheet A and the calculated inclination angle θ.

Second Exemplary Embodiment

A sheet conveying apparatus according to a second exemplary embodiment of the present invention includes orientation changing rollers and sheet detecting sensors provided in a sheet conveyance path, which are similar to those described in the first exemplary embodiment. The sheet conveying apparatus according to the present exemplary embodiment enables a user to manually insert a sheet. In general, when a sheet is manually inserted by a user, correcting the inclination of the inserted sheet is difficult.

Although the sheet conveying apparatus can include a reference plate capable of regulating the inclination of a sheet being inserted, a user is required to carefully insert a sheet along the reference plate. Accordingly, the apparatus is not easy to operate. Although the sheet conveying apparatus can include skewed rollers capable of correcting the inclination of a sheet, a very large space is required for the skewed rollers. Thus, the apparatus body cannot be downsized.

Figure 17:
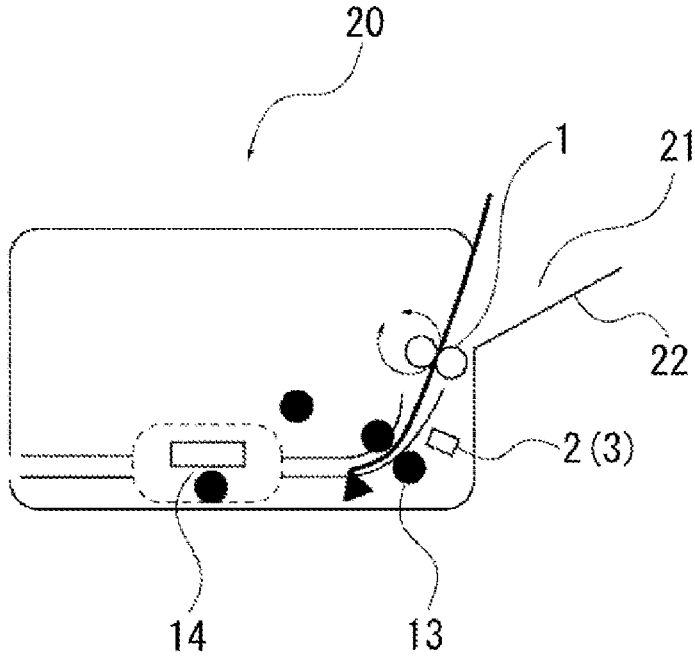
FIG. 17 is a cross-sectional diagram illustrating an image forming apparatus including a sheet conveying apparatus according to a second exemplary embodiment of the present invention.

FIG. 17 is a cross-sectional diagram illustrating an image forming apparatus 20 according to the second exemplary embodiment. The image forming apparatus 20 includes a manual feed port 21, which enables a user to manually insert a sheet, and a manual feed tray 22, which guides the sheet being manually inserted.

Figure 18:
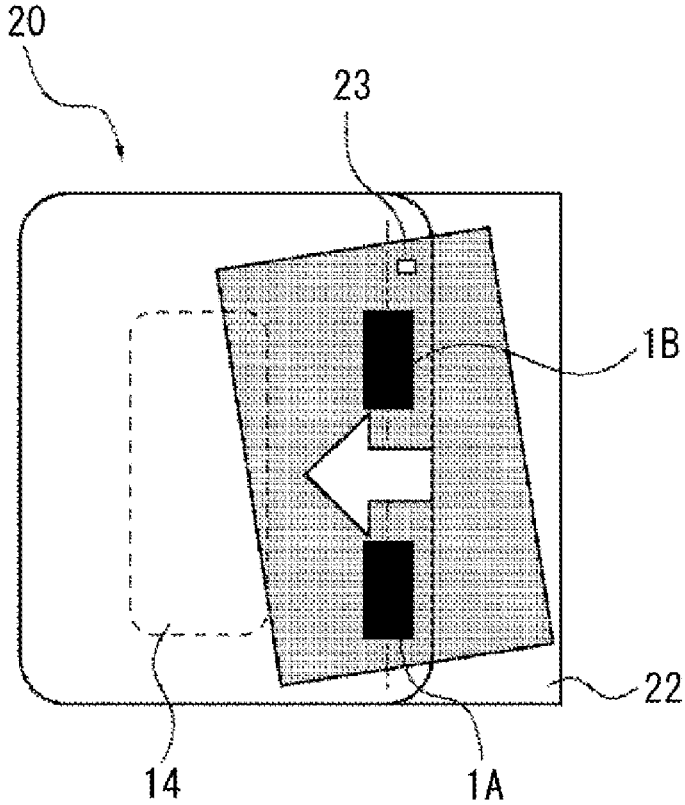
FIG. 18 is a plan diagram illustrating the sheet conveying apparatus according to the second exemplary embodiment.
Figure 19:
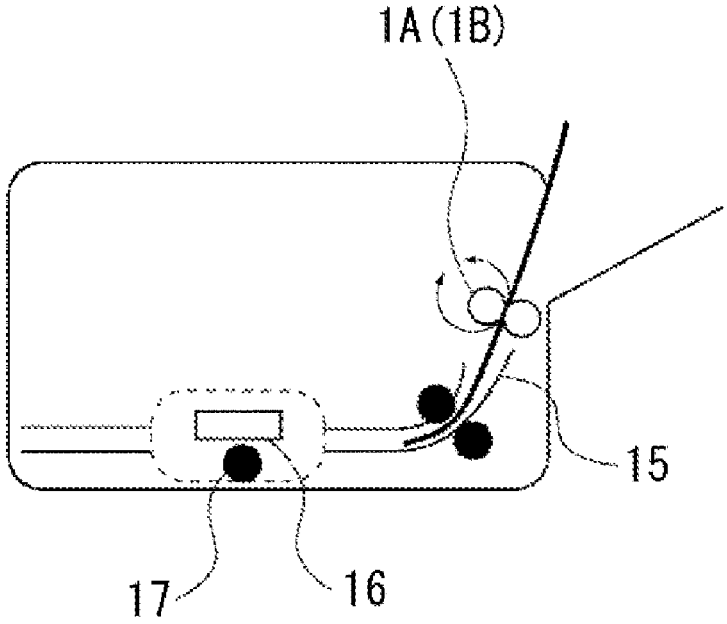
FIG. 19 is a cross-sectional diagram illustrating an operation of the sheet conveying apparatus according to the second exemplary embodiment.

FIG. 18 is a plan diagram illustrating the image forming apparatus 20. The image forming apparatus 20 includes a manual feed sensor 23, which detects a leading edge of a sheet that is inserted from the manual feed port 21.

Figure 23:
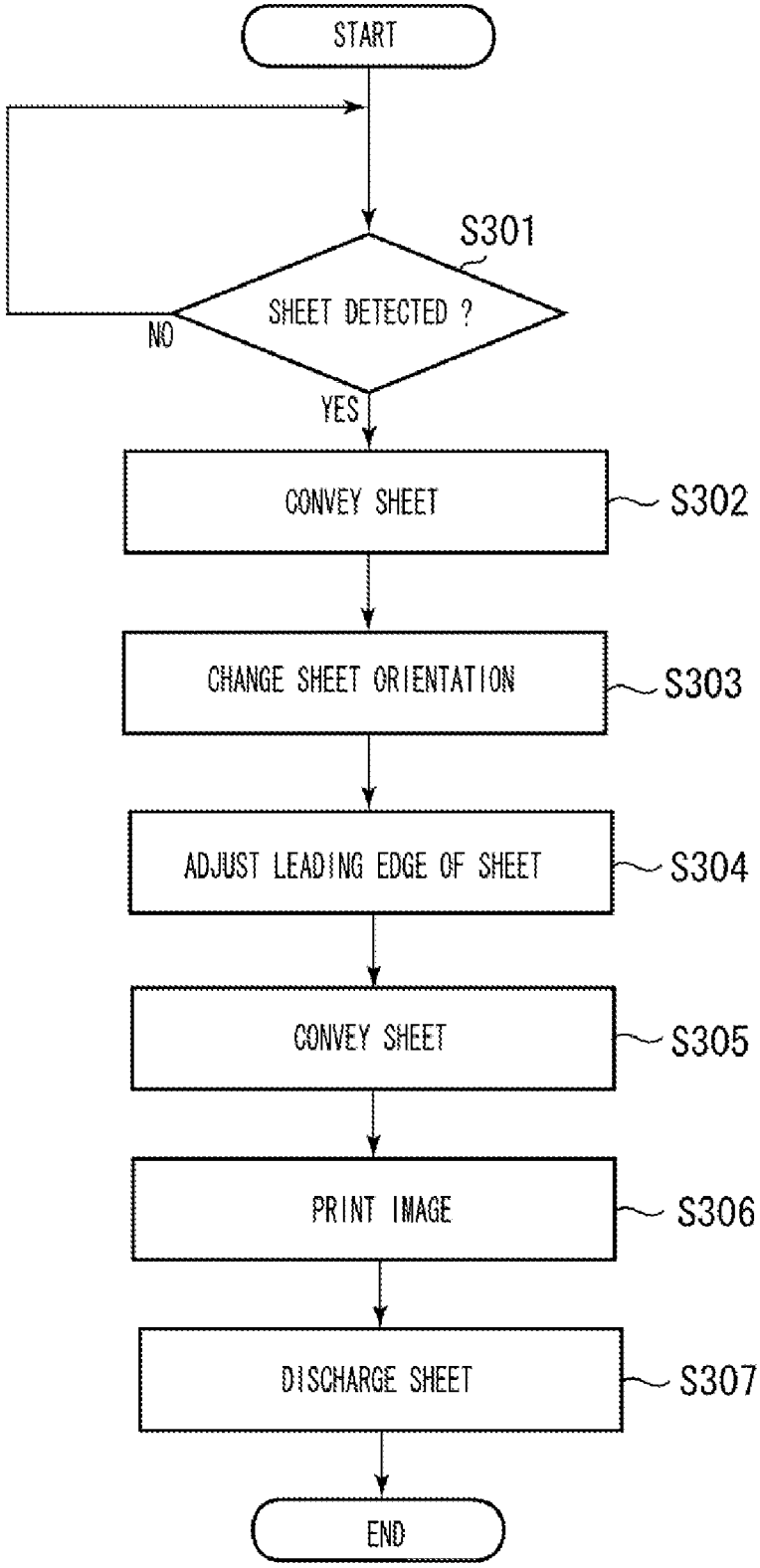
FIG. 23 is a flowchart illustrating a sheet rotating operation according to the second exemplary embodiment.

An exemplary operation of the image forming apparatus 20 according to the second exemplary embodiment is described below with reference to illustrations of FIG. 17 through 22 and a flowchart of FIG. 23. A control block diagram according to the present exemplary embodiment is similar to the above-described control block diagram illustrated in FIG. 9.

In step S301, the CPU 310 determines whether the manual feed sensor 23 has detected a leading edge of a sheet. If the manual feed sensor 23 has detected a sheet (YES in step S301), i.e., when a sheet is manually inserted, the processing flow proceeds to step S302.

In step S302, the CPU 310 causes the orientation changing motors M1 and M2 to rotate the orientation changing rollers 1A and 1B in the clockwise direction in FIG. 17 to convey the sheet along the sheet conveyance path.

In step S303 (i.e., sheet orientation changing step), the CPU 310 controls the orientation changing motors M1 and M2 such that the orientation changing roller 1B (positioned at a far side in FIG. 19) rotates in the clockwise direction and the orientation changing roller 1A (positioned at a near side in FIG. 19) rotates in the counterclockwise direction.

Figure 20:
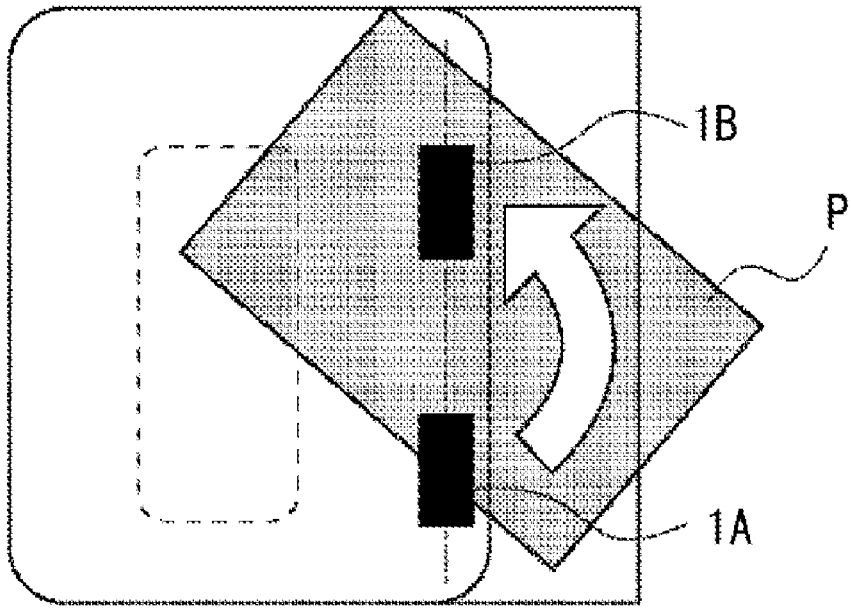
FIG. 20 is a plan diagram illustrating an operation of the sheet conveying apparatus according to the second exemplary embodiment.
Figure 21:
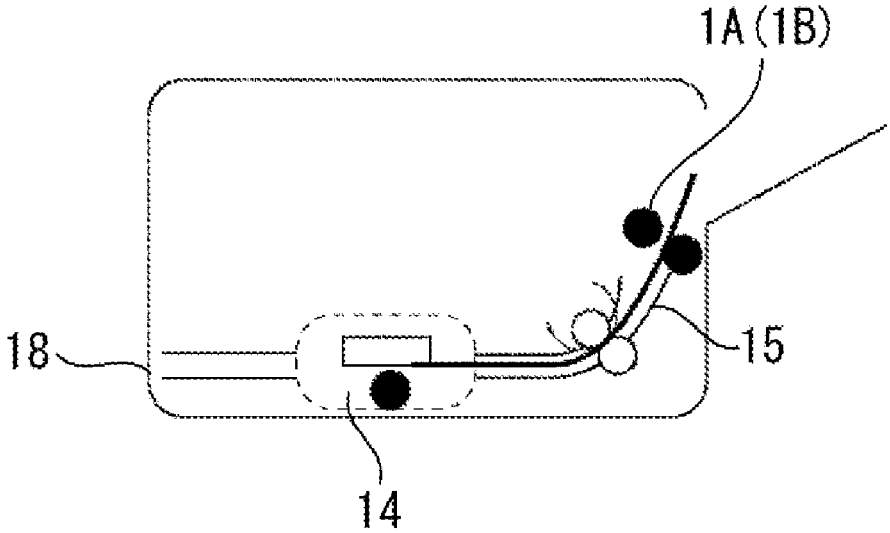
FIG. 21 is a cross-sectional diagram illustrating an operation of the sheet conveying apparatus according to the second exemplary embodiment.
Figure 22:
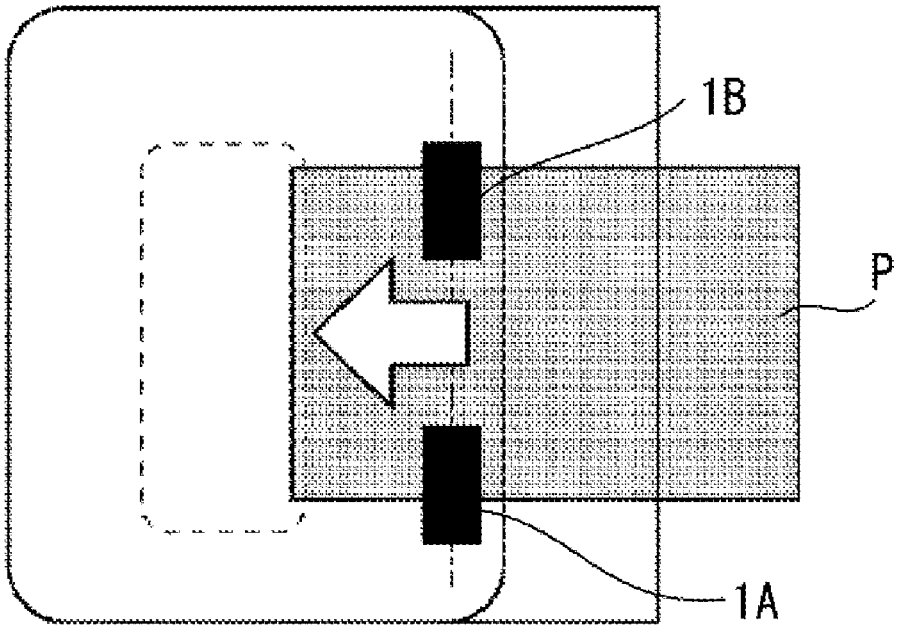
FIG. 22 is a plan diagram illustrating an operation of the sheet conveying apparatus according to the second exemplary embodiment.

FIG. 20 illustrates the sheet P rotating in the counterclockwise direction from a condition illustrated in FIG. 18, in which a shorter edge of the sheet P is approximately parallel to the sheet conveyance direction indicated by an arrow. When a longer edge of the sheet P becomes parallel to the sheet conveyance direction, the CPU 310 stops the orientation changing motors M1 and M2. When the sheet P is rotating, the conveyance roller pair 13 is kept in a separated state. Therefore, the conveyance roller pair 13 does not hold the sheet P.

The above-described sheet orientation changing operation can correct the skew of a sheet and can locate the side edge of the sheet along a reference line.

In step S304 (i.e., sheet leading edge positioning step), the CPU 310 controls the orientation changing motors M1 and M2 to rotate the orientation changing rollers 1A and 1B in the counterclockwise direction. When the sensors 2 and 3 detect the leading edge of the sheet P conveyed in the backward direction, the CPU 310 stops the orientation changing motors M1 and M2.

In this step, the control unit can recognize the leading edge of the sheet P and can determine the start timing of a recording operation performed by the recording head 16 in a succeeding step (i.e., image forming step), which starts with the leading side of the sheet P.

In step S305 (i.e., sheet conveying step), the conveyance roller pair 13 holds the sheet P. The sheet P is conveyed toward the image forming unit 14 by the orientation changing roller pair 1 and the conveyance roller pair 13.

In step S306, i.e., when the leading edge of the sheet P reaches the image forming unit 14, the recording head 16 starts recording an image on the sheet P based on an image signal.

While the recording head 16 performs the recording operation, the leading edge of the sheet P is discharged from the discharge port 18.

In step S307, a discharging unit (not illustrated) discharges the sheet P from the discharge port 18 when the recording head 16 completes the recording operation.

The sheet orientation changing operation in step S303 and the sheet leading edge positioning operation in step S304 are described below in more detail.

Figure 24:
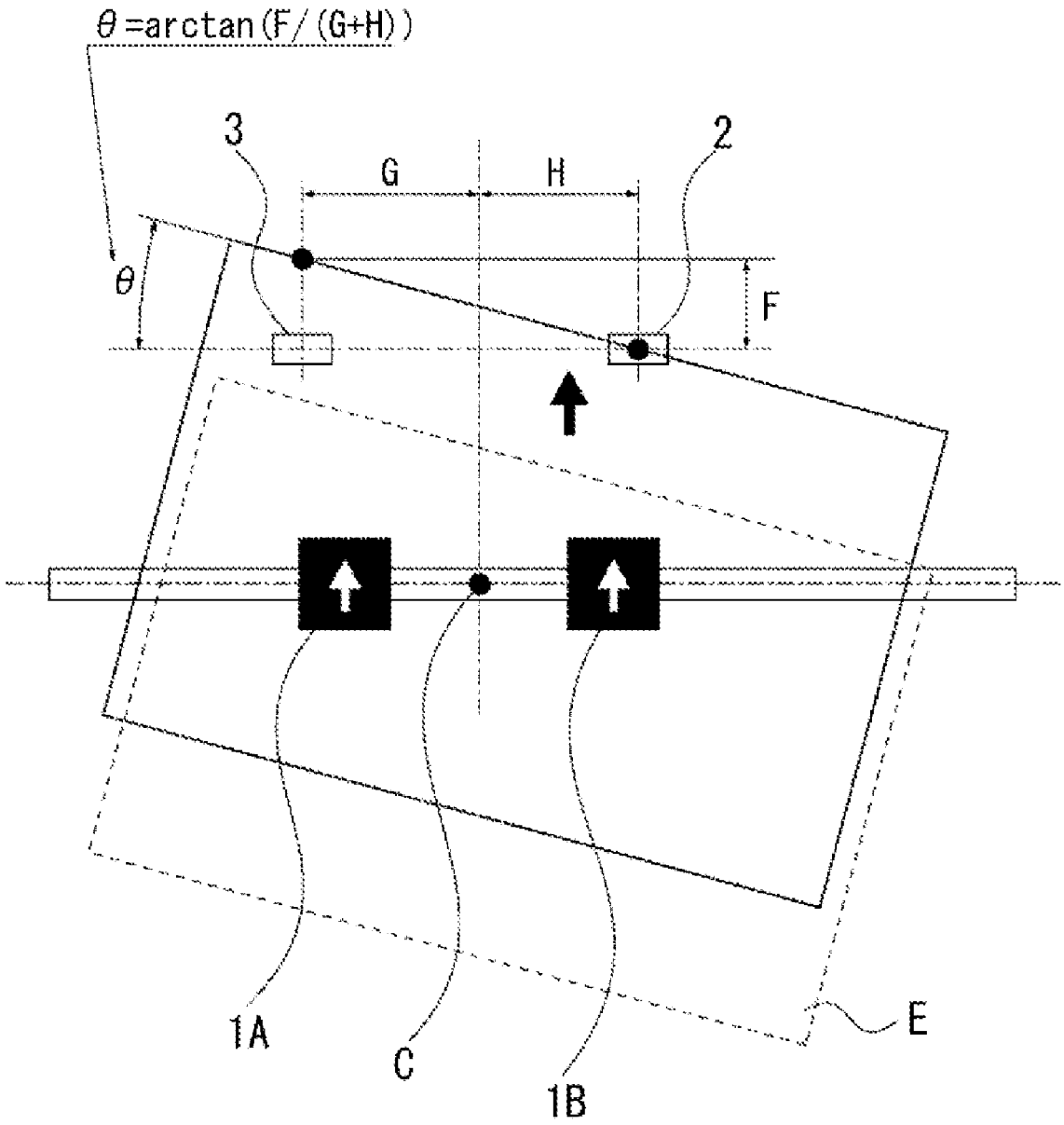
FIG. 24 illustrates an operation of the sheet conveying apparatus according to the second exemplary embodiment.

FIG. 24 is a plan diagram illustrating the sheet conveying apparatus according to the present exemplary embodiment. Similar to the first exemplary embodiment, the orientation changing rollers 1A and 1B and two sheet sensors 2 and 3 are provided on the sheet conveyance path.

In FIG. 24, "E" indicates a sheet having been manually inserted by a user. The inserted sheet may have an inclination angle θ, since the sheet conveying apparatus does not have a reference plate that can regulate insertion of the sheet.

The CPU 310 can calculate the sheet inclination θ based on the time difference of the two sensors 2 and 3 detecting passage of the sheet being conveyed by the orientation changing roller pair 1, as illustrated in FIG. 24. The CPU 310 can use the calculation formula described in the first exemplary embodiment.

Figure 25:
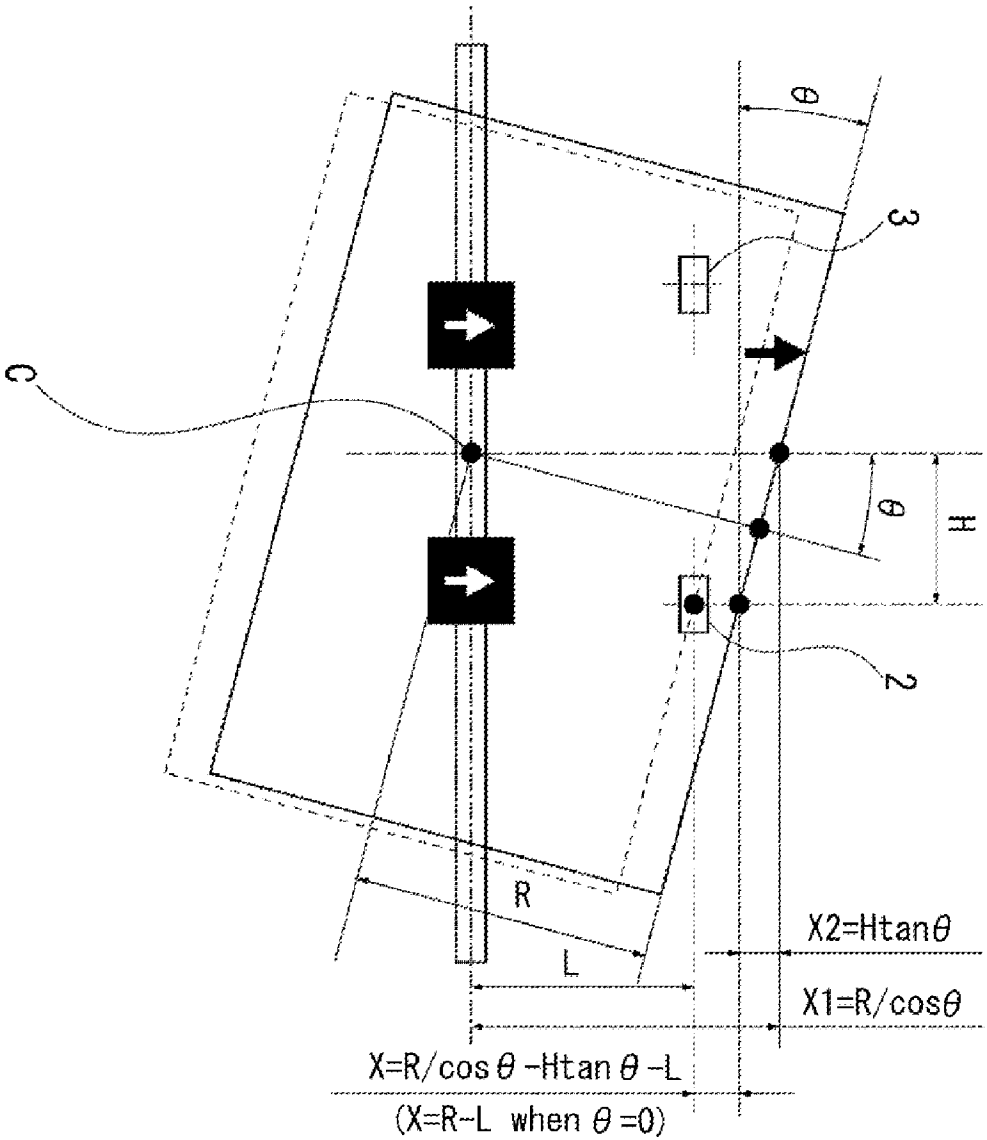
FIG. 25 illustrates an operation of the sheet conveying apparatus according to the second exemplary embodiment.

Then, the CPU 310 can calculate the conveyance amount X of the sheet having passed the sensor 2 so that a distance of the leading edge of the sheet from the rotation center C becomes a value R, as illustrated in FIG. 25. The CPU 310 can use the calculation formula described in the first exemplary embodiment.

The conveyance amount X is variable depending on the inclination angle θ so that a sheet having any inclination can be stopped at a position where a distance of the leading edge of the sheet from the rotation center C becomes the constant value R.

Then, the CPU 310 controls the orientation changing motors M1 and M2 such that the orientation changing rollers 1A and 1B rotate in mutually opposite directions until the sheet completes a rotating (yawing) motion corresponding to an angle calculated based on the following formula.

$$\theta+\pi/2$$

Figure 26:
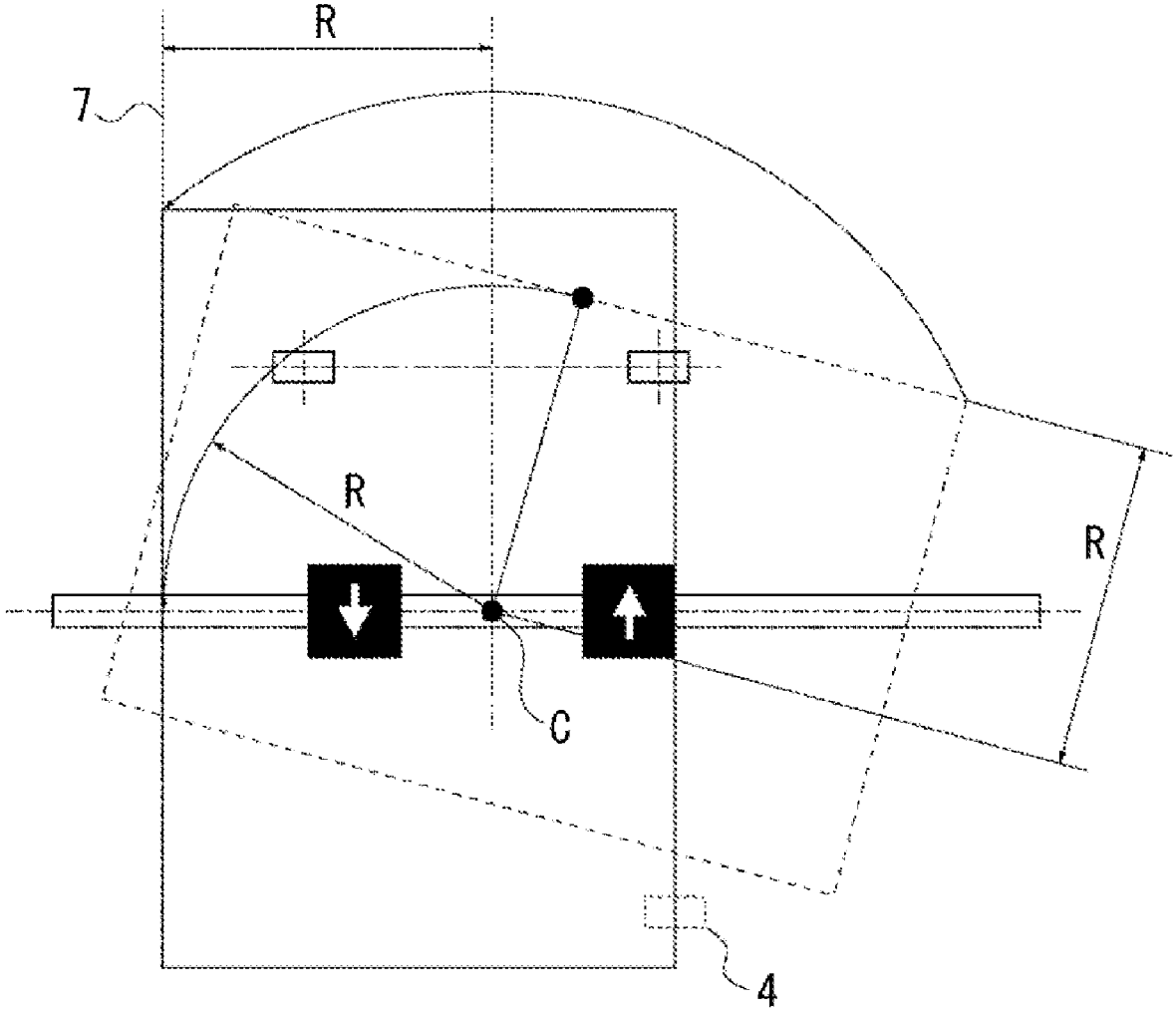
FIG. 26 illustrates an operation of the sheet conveying apparatus according to the second exemplary embodiment.

As a result, a left edge of the rotated sheet can be accurately positioned along the side edge reference line 7 as illustrated in FIG. 26.

Figure 27:
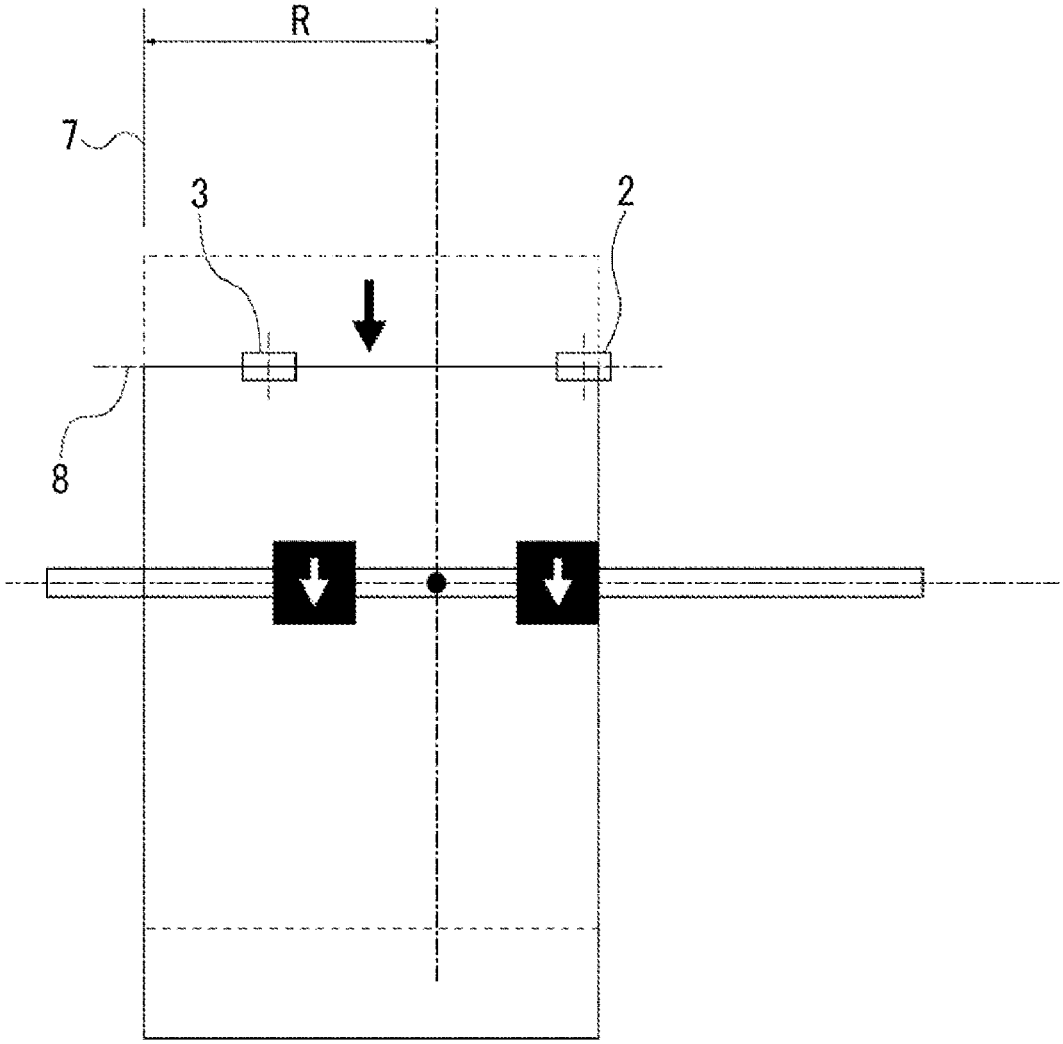
FIG. 27 illustrates an operation of the sheet conveying apparatus according to the second exemplary embodiment.
Figure 28A:
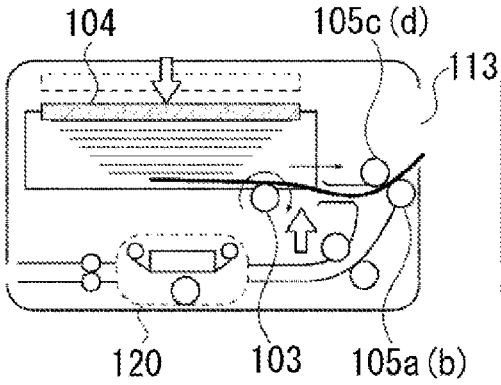
FIG. 28A PRIOR ART
FIGS. 28A to 28F are cross-sectional diagrams illustrating an operation of a conventional sheet conveying apparatus.
Figure 28B:
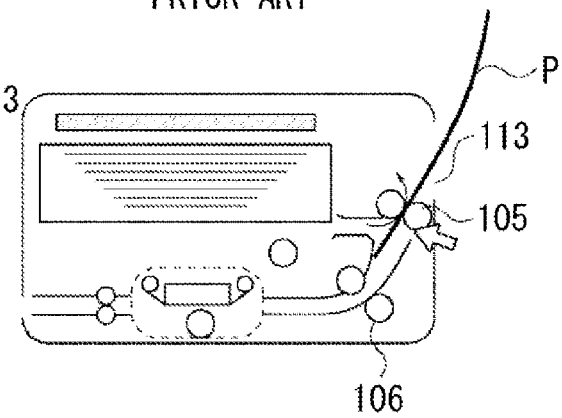
FIG. 28B PRIOR ART
Figure 28C:
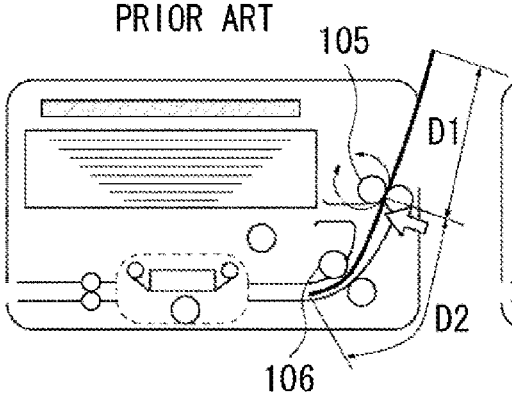
FIG. 28C PRIOR ART
Figure 28D:
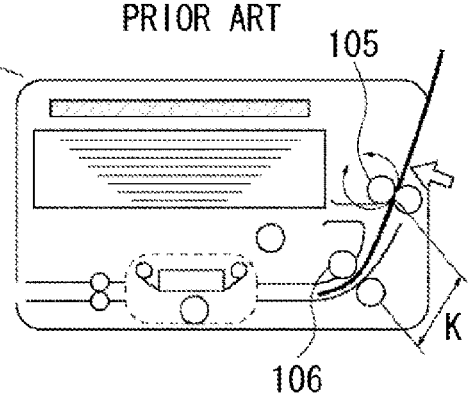
FIG. 28D PRIOR ART
Figure 28E:
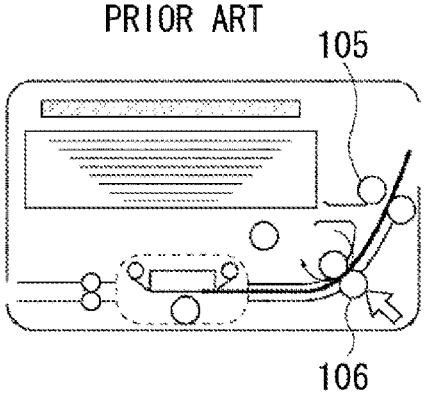
FIG. 28E PRIOR ART
Figure 28F:
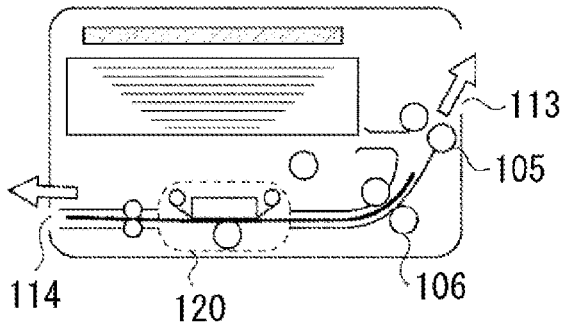
FIG. 28F PRIOR ART
Figure 29A:
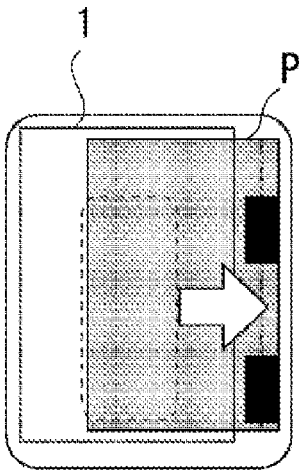
FIG. 29A PRIOR ART
FIGS. 29A to 29F are plan diagrams illustrating an operation of a conventional sheet conveying apparatus.
Figure 29B:
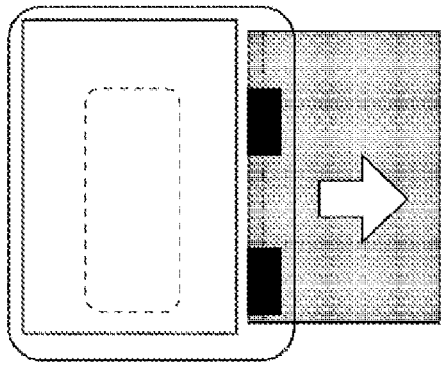
FIG. 29B PRIOR ART
Figure 29C:
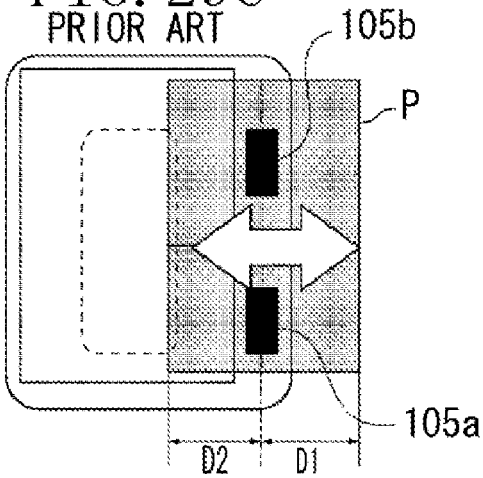
FIG. 29C PRIOR ART
Figure 29D:
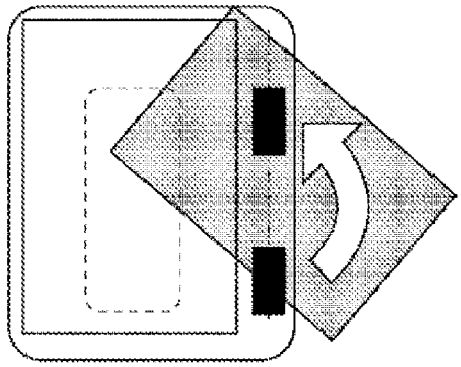
FIG. 29D PRIOR ART
Figure 29E:
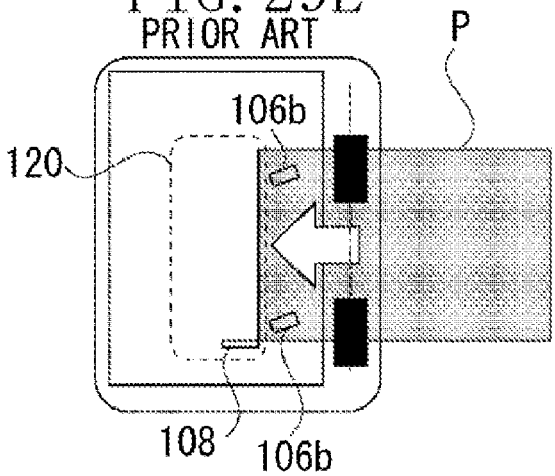
FIG. 29E PRIOR ART
Figure 29F:
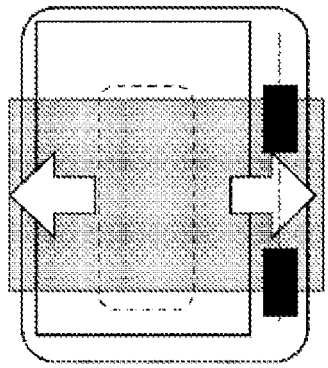
FIG. 29F PRIOR ART
Figure 30:
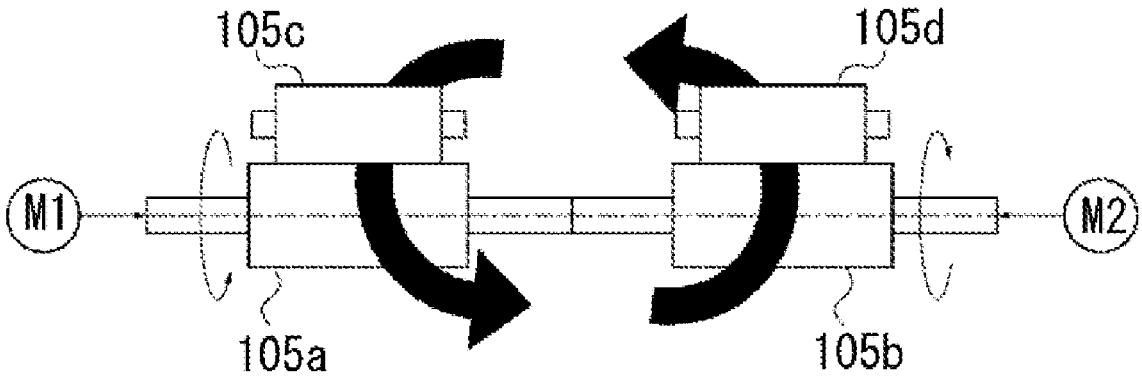
FIG. 30 PRIOR ART
FIG. 30 illustrates an operation of a conventional sheet conveying apparatus.

Then, as illustrated in FIG. 27, the orientation changing rollers 1A and 1B convey the sheet straight in the backward direction. When at least one of the sensors 2 and 3 detects the leading edge of the sheet conveyed in the backward direction, the CPU 310 stops the orientation changing motors M1 and M2. Thus, the leading edge of the sheet can be positioned along a leading edge reference line 8.

With the above-described control, the leading edge and the side edge of any sheet being inserted with an inclination angle can be accurately positioned along the leading edge reference line 8 and the side edge reference line 7, as illustrated in FIG. 27.

Thus, the sheet conveying apparatus according to the present exemplary embodiment enables a user to manually insert a recording sheet without carefully checking the inclination of the sheet. The sheet conveying apparatus according to the present exemplary embodiment is easy to operate.

Similar to the first exemplary embodiment, the sheet conveying apparatus according to the present exemplary embodiment can stop the sheet orientation changing operation based on an open loop control. Alternatively, it is useful to provide a sensor at a position 4 indicated in FIG. 26 to accurately stop the rotating motion of the sheet based on the closed loop control.

Furthermore, similar to the first exemplary embodiment, correcting the calculated inclination of the sheet is useful to improve the positioning accuracy in the open loop control.

In the present exemplary embodiment, two sensors are aligned in a direction perpendicular to the sheet conveyance direction. If the sensors deviate from each other in the sheet conveyance direction, such a deviation can be obtained beforehand as a known constant value. Thus, the inclination of a sheet can be obtained by simply adding or subtracting the known constant value (i.e., deviation) to or from the calculated inclination.

The sheet conveying apparatus according to the present exemplary embodiment rotates the sheet in the counterclockwise direction. However, similar to the first exemplary embodiment, the rotating direction is not limited to the counterclockwise direction. For example, the sheet conveying apparatus can rotate the sheet in the clockwise direction and locate the right edge of the sheet along a reference line.

As described above, the sheet conveying apparatus according to the present exemplary embodiment can accurately rotate a sheet within a small space.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-214530 filed Aug. 7, 2006, which is hereby incorporated by reference herein in its entirety.

What is claimed is:

1. A sheet conveying apparatus comprising:

a skew amount detecting unit configured to detect an amount of skew of a sheet;

two rollers configured to convey the sheet in a predetermined conveyance direction when rotating in a same direction and to rotate the sheet around a predetermined point when rotating in mutually different directions; and a control unit configured to control the two rollers such that the two rollers convey the sheet to a position where a distance from the predetermined point to a specific edge of the sheet becomes a predetermined value and then rotate the sheet based on the amount of skew detected by the skew amount detecting unit to change an orientation of the sheet, wherein the control unit controls the two rollers such that the two rollers, after rotating the sheet, convey the sheet in a direction opposed to the conveyance direction until at least one of the two sensors detects a leading edge of the sheet.

2. The sheet conveying apparatus according to claim 1, wherein the skew amount detecting unit includes two sensors configured to detect the sheet and detects the amount of skew based on a time difference between the two sensors detecting the sheet being conveyed.

3. The sheet conveying apparatus according to claim 1, wherein the two rollers rotate the sheet until the specific edge becomes parallel to the conveyance direction.

4. The sheet conveying apparatus according to claim 1, wherein a side edge of the sheet passes a reference line when the sheet is conveyed in the conveyance direction, and wherein the predetermined value is equal to a distance between the predetermined point and the reference line.

5. The sheet conveying apparatus according to claim 1, wherein the two rollers rotate the sheet around an axis perpendicular to a surface of the sheet.

6. The sheet conveying apparatus according to claim 1, wherein the two rollers rotate around a common axis perpendicular to the conveyance direction.

7. The sheet conveying apparatus according to claim 1, wherein the control unit controls the two rollers such that the two rollers rotate the sheet by an angle obtained by adding or subtracting a predetermined angle to or from a rotating angle for correcting the amount of skew detected by the skew amount detecting unit.

8. An image forming apparatus comprising:

the sheet conveying apparatus according to claim 1; and an image forming unit configured to form an image on a sheet conveyed by the sheet conveying apparatus.

9. A sheet conveying apparatus comprising:

a conveyance path configured to guide a sheet;

a manual feed port configured to allow a sheet to be manually inserted into the conveyance path;

a skew amount detecting unit configured to detect an amount of skew of the sheet inserted into the conveyance path;

two rollers configured to convey the sheet in a predetermined conveyance direction when rotating in a same direction and to rotate the sheet around a predetermined point when rotating in mutually different directions; and a control unit configured to control the two rollers such that the two rollers convey the sheet to a position where a distance from the predetermined point to a specific edge of the sheet becomes a predetermined value and then rotate the sheet based on the amount of skew detected by the skew amount detecting unit to change an orientation of the sheet, wherein the control unit controls the two rollers such that the two rollers, after rotating the sheet, convey the sheet in a direction opposed to the conveyance direction until at least one of the two sensors detects a leading edge of the sheet.

10. The sheet conveying apparatus according to claim 9, wherein the skew amount detecting unit includes two sensors configured to detect the sheet and detects the amount of skew based on a time difference between the two sensors detecting the sheet being conveyed.

11. A sheet conveying apparatus comprising:

a skew amount detecting unit configured to detect an amount of skew of a sheet;

a conveying unit configured to convey the sheet in a predetermined conveyance direction;

a rotating unit configured to rotate the sheet around a predetermined point; and a control unit configured to control the conveying unit and the rotating unit such that the conveying unit conveys the sheet to a position where a distance from the predetermined point to a specific edge of the sheet becomes a predetermined value and then the rotating unit rotates the sheet based on the amount of skew detected by the skew amount detecting unit to change an orientation of the sheet, wherein the conveying unit and the rotating unit include two rollers configured to convey the sheet in the predetermined conveyance direction when rotating in a same direction and to rotate the sheet around the predetermined point when rotating in mutually different directions.

12. A sheet conveying apparatus comprising:

an orientation changing roller pair including two rollers having a common rotational axis and configured to convey a sheet straight when rotating in a same direction and to rotate the sheet around an intermediate point of the two rollers when rotating in mutually different directions;

first and second sheet detecting sensors provided on a sheet conveyance path and arranged in a line not parallel to a predetermined sheet conveyance direction;

a measuring unit configured to measure a time difference between the first and second sheet detecting sensors detecting passage of the sheet;

a calculation unit configured to calculate an inclination angle of the sheet based on the time difference measured by the measuring unit and to calculate a correction distance determined based on the inclination angle; and a control unit configured to control the orientation changing roller pair such that the orientation changing roller pair stops the sheet after conveying the sheet by a distance obtained by adding or subtracting the correction distance to or from a predetermined distance, and then rotates the sheet to change an orientation of the sheet.

13. The sheet conveying apparatus according to claim 12, wherein the control unit causes the orientation changing roller pair to rotate the sheet by an angle obtained by adding or subtracting the inclination angle of the sheet calculated by the calculation unit to or from a predetermined angle.

14. The sheet conveying apparatus according to claim 12, wherein the orientation changing roller pair is configured to allow a sheet to be manually inserted thereinto.

* * * * *